US010236110B2

(12) United States Patent
Nishimura et al.

(10) Patent No.: US 10,236,110 B2
(45) **Date of Patent: *Mar. 19, 2019**

(54) MAGNETIC CORE, COIL COMPONENT AND MAGNETIC CORE MANUFACTURING METHOD

(71) Applicant: Hitachi Metals, Ltd., Tokyo (JP)

(72) Inventors: Kazunori Nishimura, Mishima-gun (JP); Toshio Mihara, Mishima-gun (JP); Shin Noguchi, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/124,550

(22) PCT Filed: Mar. 13, 2015

(86) PCT No.: PCT/JP2015/057526

§ 371 (c)(1),
(2) Date: Sep. 8, 2016

(87) PCT Pub. No.: WO2015/137493

PCT Pub. Date: Sep. 17, 2015

(65) Prior Publication Data

US 2017/0025214 A1 Jan. 26, 2017

(30) Foreign Application Priority Data

Mar. 13, 2014 (JP) ..... 2014-050231
Mar. 28, 2014 (JP) ..... 2014-068364

(51) Int. Cl.
*H01F 27/25* (2006.01)
*H01F 27/255* (2006.01)
(Continued)

(52) U.S. Cl.
CPC ..... *H01F 27/255* (2013.01); *B22F 3/02* (2013.01); *B22F 3/24* (2013.01); *C21D 8/1216* (2013.01);
(Continued)

(58) Field of Classification Search
None
See application file for complete search history.

(56) References Cited

U.S. PATENT DOCUMENTS 6,048,601 A 4/2000 Yahagi et al.
6,574,117 B1 6/2003 Lebo
(Continued)

FOREIGN PATENT DOCUMENTS

CN 102956342 A 3/2013
JP 11-140602 A 5/1999
(Continued)

OTHER PUBLICATIONS

Machine Translation of JP-2005-220438 A. (Year: 2005).*
(Continued)

*Primary Examiner* — Kevin M Bernatz
(74) *Attorney, Agent, or Firm* — Sughrue Mion, PLLC

(57) ABSTRACT

A magnetic core includes alloy phases 20 each made of Fe-based soft magnetic alloy grains including M1 (wherein M1 represents both elements of Al and Cr), Si, and R (wherein R represents at least one element selected from the group consisting of Y, Zr, Nb, La, Hf and Ta), and has a structure in which the alloy phases 20 are connected to each other through a grain boundary phase 30. In the grain boundary phase 30, an oxide region is produced. The oxide region includes Fe, M1, Si and R and further includes Al in a larger proportion by mass than the alloy phases 20.

16 Claims, 10 Drawing Sheets

(51) Int. Cl.

| | |
|---|---|
| ***C22C 38/00*** | (2006.01) |
| ***H01F 3/08*** | (2006.01) |
| ***H01F 41/02*** | (2006.01) |
| ***H01F 1/26*** | (2006.01) |
| ***H01F 1/33*** | (2006.01) |
| ***C22C 38/02*** | (2006.01) |
| ***C22C 38/06*** | (2006.01) |
| ***C22C 38/12*** | (2006.01) |
| ***C22C 38/14*** | (2006.01) |
| ***C22C 38/18*** | (2006.01) |
| ***C22C 33/02*** | (2006.01) |
| ***B22F 3/02*** | (2006.01) |
| ***B22F 3/24*** | (2006.01) |
| ***C21D 8/12*** | (2006.01) |
| ***C21D 9/40*** | (2006.01) |
| ***C22C 38/28*** | (2006.01) |
| ***H01F 1/147*** | (2006.01) |
| ***H01F 1/20*** | (2006.01) |
| *H01F 1/24* | (2006.01) |
| *C21D 6/00* | (2006.01) |
| *C21D 1/26* | (2006.01) |

(52) U.S. Cl.

CPC ..... *C21D 9/40* (2013.01); *C22C 33/0257* (2013.01); *C22C 38/00* (2013.01); *C22C 38/002* (2013.01); *C22C 38/005* (2013.01); *C22C 38/02* (2013.01); *C22C 38/06* (2013.01); *C22C 38/12* (2013.01); *C22C 38/14* (2013.01); *C22C 38/18* (2013.01); *C22C 38/28* (2013.01); *H01F 1/14791* (2013.01); *H01F 1/20* (2013.01); *H01F 1/26* (2013.01); *H01F 1/33* (2013.01); *H01F 3/08* (2013.01); *H01F 41/0246* (2013.01); *B22F 2003/248* (2013.01); *B22F 2998/10* (2013.01); *C21D 1/26* (2013.01); *C21D 6/002* (2013.01); *H01F 1/24* (2013.01)

(56) References Cited

U.S. PATENT DOCUMENTS

| | | | | |
|---|---|---|---|---|
| 6,741,466 | B1 | 5/2004 | Lebo | |
| 6,975,511 | B1 | 12/2005 | Lebo et al. | |
| 7,643,309 | B1 | 1/2010 | Lebo | |
| 8,289,222 | B2 * | 10/2012 | Suetsuna | H01F 1/33 343/787 |
| 9,007,159 | B2 * | 4/2015 | Hachiya | H01F 5/003 336/200 |
| 9,318,809 | B2 * | 4/2016 | Takahashi | H01Q 17/004 |
| 2002/0097124 | A1 * | 7/2002 | Inoue | H01F 1/24 336/83 |
| 2004/0052368 | A1 | 3/2004 | Spring et al. | |
| 2011/0267167 | A1 | 11/2011 | Ogawa et al. | |
| 2012/0038449 | A1 * | 2/2012 | Ogawa | H01F 1/33 336/221 |
| 2012/0274437 | A1 * | 11/2012 | Matsuura | H01F 1/14783 336/221 |
| 2012/0274438 | A1 * | 11/2012 | Hachiya | H01F 17/0013 336/221 |
| 2013/0200970 | A1 | 8/2013 | Ogawa et al. | |
| 2013/0200972 | A1 | 8/2013 | Wada et al. | |
| 2013/0228716 | A1 * | 9/2013 | Suetsuna | B22F 1/02 252/62.55 |
| 2014/0049348 | A1 | 2/2014 | Matsuura et al. | |
| 2014/0132383 | A1 | 5/2014 | Matsuura et al. | |

FOREIGN PATENT DOCUMENTS

| | | | |
|---|---|---|---|
| JP | 11-144931 | A | 5/1999 |
| JP | 3320831 | B2 | 9/2002 |
| JP | 2002-305108 | A | 10/2002 |
| JP | 2005-220438 | A | 8/2005 |
| JP | 2006-128521 | A | 5/2006 |
| JP | 2009-088496 | A | 4/2009 |
| JP | 2009-088502 | A | 4/2009 |
| JP | 2011-249774 | A | 12/2011 |
| TW | 492020 | B | 6/2002 |
| TW | 2012-043872 | A | 11/2012 |
| WO | 2012/147224 | A1 | 11/2012 |

OTHER PUBLICATIONS

Communication dated Oct. 20, 2017 from the European Patent Office in counterpart application No. 15762111.1.

International Preliminary Report on Patentability with translation of Written Opinion issued by the International Bureau in counterpart International Application No. PCT/JP2015/057526, dated Sep. 22, 2016.

International Search Report for PCT/JP2015/057526 dated May 26, 2015 [PCT/ISA/210].

Taiwanese Office Action for Application No. 104108110 dated May 17, 2016.

Communication dated Jan. 17, 2018 from the State Intellectual Property Office of the P.R.C. in counterpart application No. 201580013306.3.

Communication dated Aug. 23, 2018, from the Japanese Patent Office in counterpart application No. 2016-507851.

EP Office Action for Application No. 15 762 111.1, dated Dec. 20, 2018; 7 pages.

* cited by examiner (a)

(b)

(a)

(b)

(a)

(b)

(a)

(b)

(a)

(b)

(a)

(b)

Iron Kal (c)

Aluminum Kal (d)

Chromium Kal (e)

Zirconium Kal (f)

Oxygen Kal (a)

(b)

Iron Kal (c)

Aluminum Kal (d)

Chromium Kal (e)

Zirconium Kal (f)

Oxygen Kal

MAGNETIC CORE, COIL COMPONENT AND MAGNETIC CORE MANUFACTURING METHOD

CROSS REFERENCE TO RELATED APPLICATIONS

This application is a National Stage of International Application No. PCT/JP2015/057526 filed Mar. 13, 2015 (claiming priority based on Japanese Patent Application Nos. 2014-050231 filed Mar. 13, 2014 and 2014-068364 filed Mar. 28, 2014), the contents of which are incorporated herein by reference in their entirety.

TECHNICAL FIELD

The present invention relates to a magnetic core having a structure including alloy phases in the form of grains; a coil component using this magnetic core; and a method for manufacturing the magnetic core.

BACKGROUND ART

Hitherto, coil components such as an inductor, a transformer, and a choke coil, have been used in various articles such as household electric appliances, industrial equipment, and vehicles. A coil component includes a magnetic core and a coil fitted to the magnetic core. As this magnetic core, a ferrite magnetic core, which is excellent in magnetic property, shape flexibility and costs, has widely been used.

In recent years, a decrease in the size of power source devices of electronic instruments and others has been advancing, so that intense desires have been increased for coil components which are small in size and height, and are usable against a large current. As a result, the adoption of powder magnetic cores, in each of which a metallic magnetic powder is used, and which are higher in saturation magnetic flux density than the ferrite magnetic core, has been advancing. As metallic magnetic powders, for example, pure Fe particles, and Fe-based magnetic alloy particles such as those of Fe—Si-based, Fe—Al—Si-based and Fe—Cr—Si-based alloys are used.

The saturation magnetic flux density of any Fe-based soft magnetic alloy is, for example, 1 T or more. A magnetic core using this alloy has excellent DC superimposition characteristics even when made small in size. In the meantime, the magnetic core is small in specific resistance and large in eddy current loss since the core contains a large quantity of Fe. Thus, it has been considered that unless grains of the alloy are coated with an insulator such as resin or glass, it is difficult to use the magnetic core for any article for which a higher frequency than 100 kHz is required. However, a magnetic core in which Fe-based soft magnetic alloy grains are bonded to each other through such an insulator may be poorer in strength than ferrite magnetic cores by an effect of the insulator.

Patent Document 1 discloses a magnetic core obtained by using a soft magnetic alloy having a composition of Cr: 2 to 8 wt %, Si: 1.5 to 7 wt % and Fe: 88 to 96.5 wt %, or Al: 2 to 8 wt %, Si: 1.5 to 12 wt % and Fe: 80 to 96.5 wt %, and heat-treating a compact made of grains of the soft magnetic alloy in an atmosphere containing oxygen. When the temperature of the heat treatment is raised to 1000° C., the breaking stress of the resultant magnetic core is improved to 20 kgf/mm$^2$ (196 MPa). However, the specific resistance thereof is remarkably lowered to $2\times10^2$ Ω·cm, so that the magnetic core does not sufficiently endure both of the specific resistance and the strength.

Patent Document 2 discloses a magnetic core obtained by: applying a heat treatment at 800° C. or higher in an oxidizing atmosphere to an Fe—Cr—Al based magnetic powder including Cr: 1.0 to 30.0% by mass and Al: 1.0 to 8.0% by mass and including the balance of the core consisting substantially of Fe, thereby self-producing an aluminum-including oxidized coat film on the surface of the powder; and further solidifying and compacting the magnetic powder by discharge-plasma sintering in a vacuum chamber. This Fe—Cr—Al based magnetic powder may contain one or two of Ti: 1.0% or less by mass, and Zr: 1.0% or less by mass, and may contain, as an impurity, Si: 0.5% or less by mass. However, the resistance value of this magnetic core has as low as several milliohms; thus, the magnetic core is unsatisfactory for being used for any article for which a high frequency is required, or for the case of forming electrodes directly onto the surface of the magnetic core.

PRIOR ART DOCUMENTS

Patent Documents

Patent Document 1: JP-A-2011-249774
Patent Document 2: JP-A-2005-220438

SUMMARY OF THE INVENTION

Problems to be Solved by the Invention

In light of the above-mentioned actual situation, the present invention has been made. An object thereof is to provide a magnetic core excellent in specific resistance and strength, a coil component using this magnetic core, and a method for manufacturing the magnetic core.

Means for Solving the Problems

The object can be achieved by the following present invention. According to a first aspect of the present invention, there is provided a magnetic core, which comprises alloy phases each comprising Fe-based soft magnetic alloy grains comprising M1 (wherein M1 represents both elements of Al and Cr), Si, and R (wherein R represents at least one element selected from the group consisting of Y, Zr, Nb, La, Hf and Ta), and which has a structure in which the alloy phases are connected to each other through a grain boundary phase, wherein the grain boundary phase comprises an oxide region comprising Fe, M1, Si and R and further comprising Al in a larger proportion by mass than the alloy phases.

In the magnetic core in accordance with the first aspect of the present invention, it is preferable to comprise Al in a proportion of 3 to 10% both inclusive by mass, Cr in a proportion of 3 to 10% both inclusive by mass, and R in a proportion of 0.01 to 1% both inclusive by mass provided that the sum of the quantities of Fe, M1 and R is regarded as being 100% by mass; and comprise Fe and inevitable impurities as the balance of the core. Further, it is preferable to comprise R in a proportion of 0.3% or more by mass. Further, it is preferable to comprise R in a proportion of 0.6% or less by mass.

Further, according to a second aspect of the present invention, there is provided a magnetic core, which comprises alloy phases each comprising Fe-based soft magnetic alloy grains comprising M2 (wherein M2 represents either Al or Cr), Si, and R (wherein R represents at least one element selected from the group consisting of Y, Zr, Nb, La, Hf and Ta), and which has a structure in which the alloy phases are connected to each other through a grain boundary phase, wherein the grain boundary phase comprises an oxide region comprising Fe, M2, Si and R and further comprising M2 in a larger proportion by mass than the alloy phases.

In the magnetic core in accordance with the second aspect of the present invention, it is preferable to comprise M2 in a proportion of 1.5 to 8% both inclusive by mass, Si in a proportion more than 1% by mass and 7% or less by mass, and R in a proportion of 0.01 to 3% both inclusive by mass provided that the sum of the quantities of Fe, M2, Si and R is regarded as being 100% by mass; and comprise Fe and inevitable impurities as the balance of the core. Further, it is preferable to comprise R in a proportion of 0.3% or more by mass. Further, it is preferable to comprise R in a proportion of 0.6% or less by mass.

In the magnetic core in accordance with the present invention, it is preferable that the oxide region includes a region having a higher proportion of the quantity of R than a region which is different from the higher-R-proportion region and is inside the oxide region.

In the magnetic core in accordance with the first aspect of the present invention, it is preferable that the grain boundary phase has: a first region where the ratio of the quantity of Al to the sum of the quantities of Fe, M1, Si and R is higher than the ratio of the quantity of each of Fe, Cr, Si and R thereto; and a second region where the ratio of the quantity of Fe to the sum of the quantities of Fe, M1, Si and R is higher than the ratio of the quantity of each of M1, Si and R thereto.

In the magnetic core in accordance with the first aspect of the present invention, it is preferable to have a specific resistance of $1\times10^5$ Ω·m or more and a radial crushing strength of 120 MPa or more. Respective values of the specific resistance and the radial crushing strength are specifically values obtained by measuring methods in the item EXAMPLES, which will be described later.

The coil component according to the present invention is a component including the magnetic core according to the present invention, and a coil fitted to the magnetic core.

A magnetic core manufacturing method in accordance with the present invention comprises the steps of: mixing a binder with Fe-based soft magnetic alloy grains comprising M1 (wherein M1 represents both elements of Al and Cr), Si, and R (wherein R represents at least one element selected from the group consisting of Y, Zr, Nb, La, Hf and Ta) to yield a mixed powder; subjecting the mixed powder to pressing to yield a compact; and subjecting the compact to heat treatment in an atmosphere comprising oxygen to yield a magnetic core having a structure comprising alloy phases comprising the Fe-based soft magnetic alloy grains. The heat treatment results in: forming a grain boundary phase through which the alloy phases are connected to each other; and further producing, in the grain boundary phase, an oxide region comprising Fe, M1, Si and R and further comprising Al in a larger proportion by mass than the alloy phases.

The other magnetic core manufacturing method in accordance with the present invention comprises the steps of: mixing a binder with Fe-based soft magnetic alloy grains comprising M2 (wherein M2 represents either Al or Cr), Si, and R (wherein R represents at least one element selected from the group consisting of Y, La, Zr, Hf, Nb and Ta) to yield a mixed powder; and subjecting the mixed powder to pressing to yield a compact; subjecting the compact to heat treatment in an atmosphere comprising oxygen to yield a magnetic core having a structure comprising alloy phases comprising the Fe-based soft magnetic alloy grains. The heat treatment results in: forming a grain boundary phase through which the alloy phases are connected to each other; and further producing, in the grain boundary phase, an oxide region comprising Fe, M2, Si and R and further comprising M2 in a larger proportion by mass than the alloy phases.

Effect of the Invention

The present invention makes it possible to provide a magnetic core excellent in specific resistance and strength, a coil component using this magnetic core, and a method for manufacturing the magnetic core.

MODE FOR CARRYING OUT THE INVENTION

Hereinafter, embodiments of the present invention will be specifically described. However, the invention is not limited to these embodiments.

First Aspect

The first aspect of the present invention will be specifically described. As will be detailed later, the magnetic core of the first aspect includes alloy phases each including Fe-based soft magnetic alloy grains including M1, Si, and R, and has a structure in which the alloy phases are connected to each other through a grain boundary phase.

Figure 1:
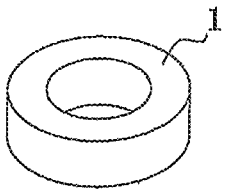
FIG. 1 is an external view illustrating an example of the magnetic core according to the present invention.
Figure 2:
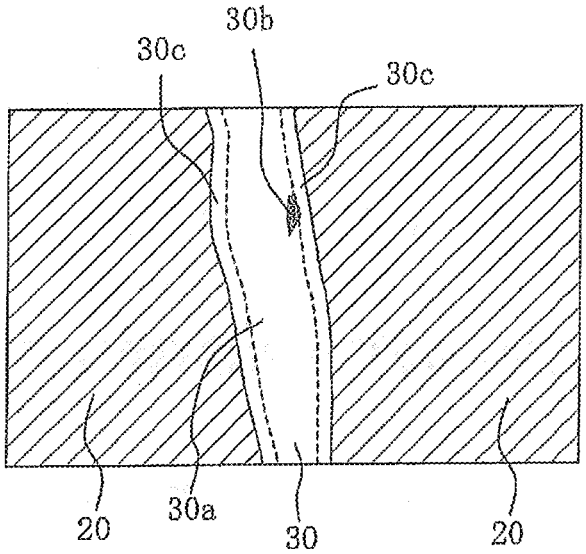
FIG. 2 is a schematic view showing an example of a microstructure of a magnetic core according to the first aspect of the present invention in a cross section of the core.

A magnetic core 1 illustrated in FIG. 1 has, in a cross section thereof, a microstructure as shown in, e.g., FIG. 2. This microstructure of the cross section is viewed through an observation at a magnifying power of 600000 or more, using, e.g., a transmission electron microscope (TEM). This structure includes alloy phases 20 which each include Fe (iron), M1 and Si and are in the form of grains. Any adjacent two of the alloy phases 20 are connected to each other through a grain boundary phase 30. M1 is both elements of Al (aluminum) and Cr (chromium). The grain boundary phase 30 is formed by heat treatment which will be detailed later in an atmosphere containing oxygen. The grain boundary phase 30 has an oxide region including Fe, M1, Si and R and further including Al in a larger proportion by mass than the alloy phases 20. The oxide region has the following at an interface side of this region, the interface being an interface between the oxide region and the alloy phases 20: a region including R in a larger proportion than the alloy phases 20. R is at least one element selected from the group consisting of Y (yttrium), Zr (zirconium), Nb (niobium), La (lanthanum), Hf (hafnium) and Ta (tantalum).

The alloy phases 20 are each formed by Fe-based soft magnetic alloy grains including Al, Cr, Si and R and including, as the balance of the grains, Fe and inevitable impurities. The non-ferrous metals (that is, Al, Cr and R) included in the Fe-based soft magnetic alloy grains are each larger in affinity with O (oxygen) than Fe. Thus, when the Fe-based soft magnetic alloy is heat-treated in an atmosphere containing oxygen, respective oxides of these non-ferrous metals, or multiple oxides of the non-ferrous metals with Fe are produced, and then the surface of the Fe-based soft magnetic alloy grains is coated with the (multiple) oxides. Furthermore, gaps between the grains are filled with the (multiple) oxides. In this way, the oxide region is a region obtained mainly by causing oxygen to react with the Fe-based soft magnetic alloy grains by the heat treatment and further growing the reaction product. Thus, the oxide region is formed by an oxidization reaction which exceeds natural oxidization of the Fe-based soft magnetic alloy grains. Fe and the respective oxides of the non-ferrous metals have a higher electrical resistance than a simple substance of each of the metals, so that the grain boundary phase 30 intervening between the alloy phases 20 functions as an insulating layer.

The Fe-based soft magnetic alloy grains used for forming the alloy phases 20 include, as a main component highest in content by percentage, Fe among the constituting components of the grains. The grains include, as secondary components thereof, Al, Cr, Si, and at least one of Y, Zr, Nb, La, Hf and Ta. Each of Y, Zr, Nb, La, Hf and Ta is not easily dissolved in Fe into a solid solution. Additionally, the absolute value of the standard production Gibbs energy of the oxide is relatively large (the oxide is easily produced). Fe is a main element for constituting the Fe-based soft magnetic alloy grains, and affects the saturation magnetic flux density and other magnetic properties thereof, as well as the strength and other mechanical properties thereof. The Fe-based soft magnetic alloy grains contain Fe preferably in a proportion of 80% or more by mass, this proportion being dependent on the balance between Fe and the other non-ferrous metals. This case makes it possible to yield a soft magnetic alloy high in saturation magnetic flux density.

Al is larger in affinity with O than Fe and other non-ferrous metals. Thus, when the Fe-based soft magnetic alloy is heat-treated, O in the air atmosphere or O in the binder is preferentially bonded to Al near the surface of the Fe-based soft magnetic alloy grains to produce $Al_2O_3$, which is chemically stable, and multiple oxides of the other non-ferrous metals with Al on the surface of the alloy phases 20. Moreover, O which is to invade the alloy phases 20 reacts with Al so that Al-including oxides are produced one after another. Consequently, the invasion of O into the alloy phases 20 is prevented to restrain an increase in the concentration of O, which is an impurity, so that the resultant can be prevented from being deteriorated in magnetic properties. The Al-including oxide region excellent in corrosion resistance and stability is produced on the surface of the alloy phases 20. This production makes it possible to heighten the insulating property between the alloy phases 20 and decrease eddy current loss, so that the magnetic core can be improved in specific resistance.

The Fe-based soft magnetic alloy grains include Al preferably in a proportion of 3 to 10% both inclusive by mass. If this proportion is less than 3% by mass, Al-including oxides may not be sufficiently produced to lower the oxide region in insulating property and corrosion resistance. The Al content is more preferably 3.5% or more by mass, even more preferably 4.0% or more by mass, particularly preferably 4.5% or more by mass. In the meantime, if the proportion is more than 10% by mass, the quantity of Fe is decreased so that the resultant magnetic core may be deteriorated in magnetic properties, for example, the core may be lowered in saturation magnetic flux density and initial permeability and be increased in coercive force. The Al content is more preferably 8.0% or less by mass, even more preferably 6.0% or less by mass, particularly preferably 5.0% or less by mass.

Cr is largest in affinity with O next to Al. In the heat treatment, Cr is bonded to O in the same manner Al to produce $Cr_2O_3$, which is chemically stable, and multiple oxides of the other non-ferrous metals with Cr. In the meantime, Cr in the produced oxides easily becomes smaller in quantity than Al since the Al-including oxides are preferentially produced. The Cr-including oxides are excellent in corrosion resistance and stability to enhance the insulating property between the alloy phases 20, so that the resultant magnetic core can be decreased in eddy current loss.

The Fe-based soft magnetic alloy grains include Cr preferably in a proportion of 3 to 10% both inclusive by mass. If this proportion is less than 3% by mass, Cr-including oxides may not be sufficiently produced so that the oxide region may be lowered in insulating property and corrosion resistance. The Cr content is more preferably 3.5% or more by mass, even more preferably 3.8% or more by mass. In the meantime, if this proportion is more than 10% by mass, the quantity of Fe is decreased so that the magnetic core may be deteriorated in magnetic properties, for example, the core may be lowered in saturation magnetic flux density and initial permeability and be increased in coercive force. The Cr content is more preferably 9.0% or less by mass, even more preferably 7.0% or less by mass, particularly preferably 5.0% or less by mass.

In order to heighten the insulating property and corrosion resistance, the total content of Al and Cr is preferably 7% or more by mass, more preferably 8% or more by mass. In order to restrain the change rate of the magnetic core loss which depends on the heat treatment temperature to ensure a wide control scope of the heat treatment temperature, the total content of Cr and Al is more preferably 11% or more by mass. Moreover, Al becomes remarkably larger in concentration than Cr in the oxide region between the alloy phases 20; thus, it is more preferred to use Fe-based soft magnetic alloy grains in which Al is lager in content by percentage than Cr.

R (at least one of Y, Zr, Nb, La, Hf and Ta) is not easily dissolved in Fe into a solid solution, and further the absolute value of the standard production Gibbs energy of any oxide thereof is large. In Table 1 is shown the standard production Gibbs energy of each of typical oxides which the element R forms. Any one of the R oxides has a negative value of the standard production Gibbs energy, and the absolute value thereof is larger than that of $Fe_2O_3$ or $Fe_3O_4$. This matter demonstrates that the element R is more easily oxidized than Fe and is strongly bonded with O to produce a stable oxide such as $ZrO_2$. Moreover, Fe is not easily turned into a solid solution so that R precipitates easily as an oxide film onto surfaces of the grains. Thus, this oxide film, together with any Al oxide that constitutes a main body of the oxide region making its appearance on the grain boundary phase 30 in the heat treatment, forms a strong oxidized coat film making its appearance in the grain boundary phase 30 to heighten the insulating property between the alloy phases. Accordingly, the specific resistance of the magnetic core can be improved.

As will be detailed later, an R-including oxide is produced along any edge part of the oxide region along the interface between the alloy phases 20 and the grain boundary phase 30, thereby restraining the diffusion of Fe effectively from the alloy phases 20 to the grain boundary phase 30, and decreasing chances of contact between the alloy phases. Consequently, the magnetic core can be heightened in insulating property by the oxide region to be improved in specific resistance. As described above, R is not easily dissolved in Fe into a solid solution; therefore, in Fe-based soft magnetic alloy grains produced by an atomizing method as will be detailed later, R is easily concentrated on the grain surfaces thereof. Thus, R produces a sufficient advantageous effect even when added, in a fine amount.

TABLE 1

| Element | Oxide | Standard production Gibbs energy (kJ/mol) |
|---|---|---|
| Y | $Y_2O_3$ | −1817 |
| Zr | $ZrO_2$ | −1043 |
| Nb | $Nb_2O_5$ | −1766 |
| La | $La_2O_3$ | −1911 |
| Hf | $HfO_2$ | −1088 |
| Ta | $Ta_2O_5$ | −1911 |
| Fe | $Fe_2O_3$ | −742 |
| | $Fe_3O_4$ | −1015 |

Reference source: Chemical Handbook, basic part, $5^{th}$ revised edition (Maruzen, 2004)

The Fe-based soft magnetic alloy grains include R preferably in a proportion of 0.01 to 1% both inclusive by mass. If this proportion is less than 0.01% by mass, an R-including oxide is not sufficiently produced so that R may not sufficiently produce the improving effect for specific resistance. The R content is more preferably 0.1% or more by mass, even more preferably 0.2% or more by mass, particularly preferably 0.3% or more by mass. In the meantime, if this proportion is more than 1% by mass, the magnetic core may undergo, for example, an increase in magnetic core loss not to gain magnetic properties appropriately. The R content is more preferably 0.9% or less by mass, even more preferably 0.8% or less by mass, even more preferably 0.7% or less by mass, particularly preferably 0.6% or less by mass. When R is two or more elements selected from the group consisting of Y, Zr, Nb, La, Hf and Ta, the proportion of the total amount of these elements is preferably from 0.01 to 1% both inclusive by mass.

The following tendency has been made clear: when Ti (titanium), which is an element in the Group IV in the periodic table in the same manner as Zr or Hf, is used alone, the magnetic core is increased in radial crushing strength in the same manner as when the core contains R, so as to gain a relatively higher initial permeability and a smaller magnetic core loss than when the core contains R; however, the magnetic core is lowered in specific resistance. A cause therefor would be as follows: the standard production Gibbs energy of $TiO_2$ is −890 kJ/mol, and the absolute value thereof is smaller than that of $Fe_3O_4$ so that a strong oxidized coat film is not appropriately formed. However, even when the magnetic core contains Ti, the use of Ti together with the element R makes it possible to improve the specific resistance while the strength is kept. When the magnetic core contains Ti, the Ti content is preferably less than 0.3% by mass, more preferably less than 0.1% by mass, even preferably less than 0.01% by mass. The total content of R and Ti is preferably 1% or less by mass to give appropriate magnetic properties to the magnetic core.

The Fe-based soft magnetic alloy grains may contain C (carbon), Mn (manganese), P (phosphorus), S (sulfur), O, Ni (nickel), N (nitrogen) and others as inevitable impurities. The content of each of these inevitable impurities is preferably as follows: C≤0.05% by mass; Mn≤1% by mass; P≤0.02% by mass; S≤0.02% by mass; O≤0.5% by mass; Ni≤0.5% by mass; and N≤0.1% by mass. Si (silicon) may also be contained as an inevitable impurity in the Fe-based soft magnetic alloy grains.

In an ordinary refining step for any Fe-based soft magnetic alloy, Si is usually used as a deoxidizing agent to remove O, which is an impurity. The added element Si is separated in the form of an oxide to be removed in the refining step. However, in many cases, a partial fraction of Si is contained as an inevitable impurity in the alloy in a proportion up to about 0.5% by mass. Moreover, Si may be contained in the alloy in a proportion up to about 1% by mass, which depends on raw material to be used. A Si-containing material can be refined by using a raw material high in purity and subjecting the material to, for example, vacuum melting. However, the adjustment of the proportion into a value less than 0.05% by mass makes the mass productivity of magnetic cores poor. The adjustment is not preferred for costs, either. Thus, in the first aspect, the proportion of Si is set preferably into the range of 0.05 to 1% by mass. This range of the Si proportion is a range not only when Si is present as an inevitable impurity (the range is typically 0.5% or less by mass) but also when Si is added in a small amount. The adjustment of the Si proportion into this range can heighten the initial permeability and decrease the magnetic core loss. With an increase of the Si proportion, the magnetic core tends to be lowered in specific resistance and radial crushing strength. In order for the magnetic core to gain a high specific resistance and a high radial crushing strength, it is preferred to control the proportion of Si to a low value equivalent to that of the inevitable impurities and make the proportion of R larger than that of Si.

In the example in FIG. 2, an oxide including R (such as Zr) is produced in any edge part 30*c* of the oxide region along the interface between the alloy phases 20 and the grain boundary phase 30. As has been already described, the oxide region contains Al in a larger proportion than the alloy phases 20. In the oxide region, the edge part 30*c* contains R in a larger proportion than a central part 30*a*. The production of the R-including oxide along the edge part 30*c* effectively restrains the diffusion of Fe from the alloy phases 20 to the grain boundary phase 30 to heighten the insulating property of the magnetic core by the oxide region, thereby contributing to an improvement thereof in specific resistance.

The grain boundary phase 30 is made substantially of one or more oxides. As shown in FIG. 2, an island-form region 30*b* may be formed. The region 30*b* is surrounded by the central part 30*a* and the edge part 30*c*. Hereinafter, any description will be made on conditions that: the central part 30*a* in the oxide region is referred to as the first region; the island-form region 30*b*, to as the second region; and the edge part 30*c*, to as the third region. In the microstructure of the cross section illustrated in FIG. 2, the single island-form second region 30*b* is drawn in the grain boundary phase 30. However, plural second regions may be scattered. The first region 30*a* and the third region 30*c* are regions where the ratio of the quantity of Al to the sum of the quantities of Fe, Al, Cr, Si and R is higher than the ratio of the quantity of each of Fe, Cr and R thereto. The second region 30*b* is a region where the ratio of the quantity of Fe to the sum of the quantities of Fe, Cr, Al, Si and R is higher than the ratio of the quantity of each of Al, Cr and R thereto. The second region 30*b*, where Fe is concentrated, is surrounded by the first region 30*a* and the third region 30*c*, where Al is concentrated, thereby yielding a magnetic core excellent in specific resistance.

In many cases, the alloy phases are in the form of grains, and the grains are each in the form of a polycrystal made of alloy crystals. However, the grains may each be in the form of a monocrystal made only of a single crystal. It is preferred that the alloy phases are each independent through the grain boundary phase 30 without being brought into direct contact. The structure which the magnetic core has includes the alloy phases 20 and the grain boundary phase 30, and the grain boundary phase 30 is formed mainly by oxidizing the Fe-based soft magnetic alloy grains by heat treatment. Accordingly, the alloy phases are different in composition from the above-mentioned Fe-based soft magnetic alloy grains. However, by, e.g., the evaporation and scattering of Fe, Al, Cr and R on the basis of the heat treatment, a shift or deviation of the composition is not easily caused so that in any region including the alloy phases and the grain boundary phase, the composition of the magnetic core from which O is excluded becomes substantially equal in composition to the Fe-based soft magnetic alloy grains. Such a magnetic core composition is quantitatively determined by analyzing a cross section of the magnetic core by an analyzing method such as scanning electron microscopy with energy dispersive X-ray spectroscopy (SEM/EDX). Accordingly, a magnetic core formed using Fe-based soft magnetic alloy grains as described above is a core which includes Al in a proportion of 3 to 10% both inclusive by mass, Cr in a proportion of 3 to 10% both inclusive by mass, and R in a proportion of 0.01 to 1% both inclusive by mass provided that the sum of the quantities of Fe, Al, Cr and R is regarded as being 100% by mass; and which includes Fe and inevitable impurities as the balance of the core. This magnetic core also includes Si in a proportion of 1% or less by mass.

The coil component according to the present invention has a magnetic core as described above, and a coil fitted to the magnetic core, and is used as, e.g., a choke, an inductor, a reactor, or a transformer. Electrodes to which ends of the coil are to be connected may be formed on the surface of the magnetic core by, e.g., a plating or baking method. The coil may be formed by winding a conductive line directly onto the magnetic core, or winding a conductive line onto a bobbin made of heat resistance resin. The coil is wound onto the circumference of the magnetic core, or arranged inside the magnetic core. In the latter case, a coil component may be formed which has a magnetic core having a coil sealed-in structure in which the coil is arranged to be sandwiched between a pair of magnetic cores.

Figure 3:
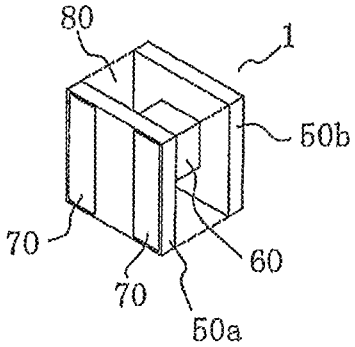
FIG. 3 is an external view illustrating an example of a coil component according to the present invention.
Figure 4:
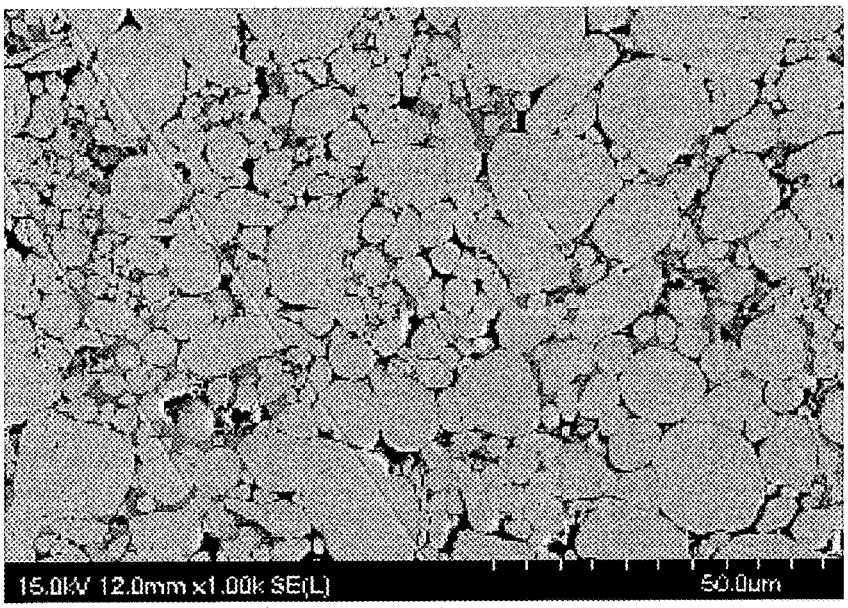
FIGS. 4(*a*) and 4(*b*) are SEM photographs obtained by observing a cross section of a magnetic core of Reference Example 1.
Figure 4:
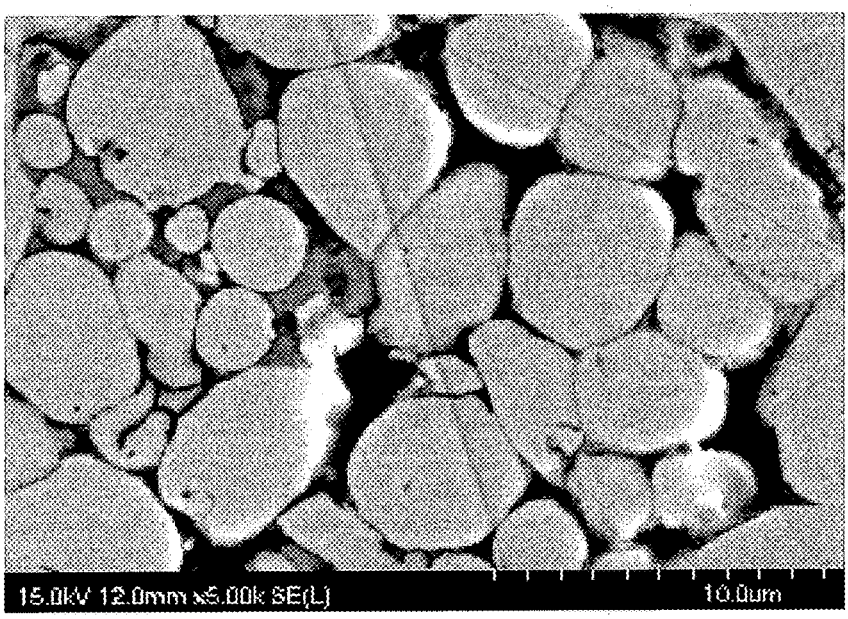
Figure 5:
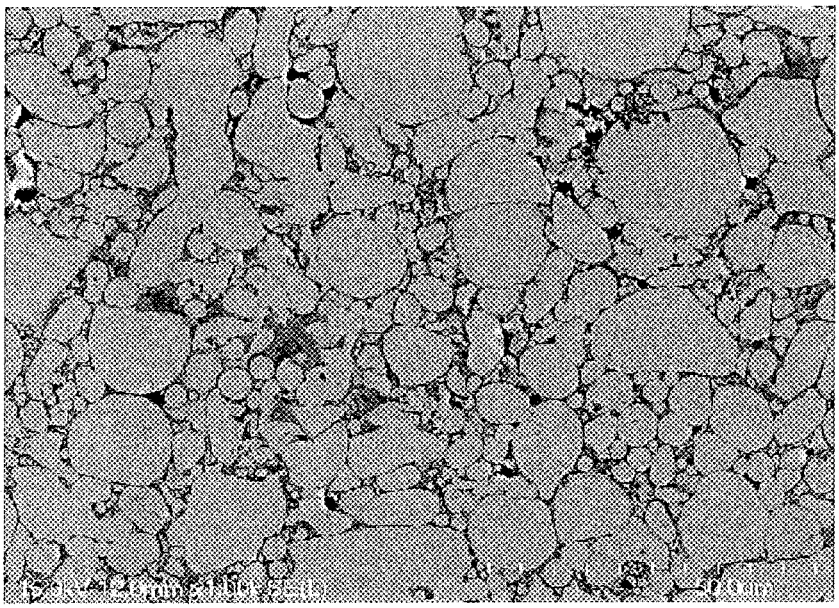
FIGS. 5(*a*) and 5(*b*) are SEM photographs obtained by observing a cross section of a magnetic core of Working Example 1.
Figure 5:
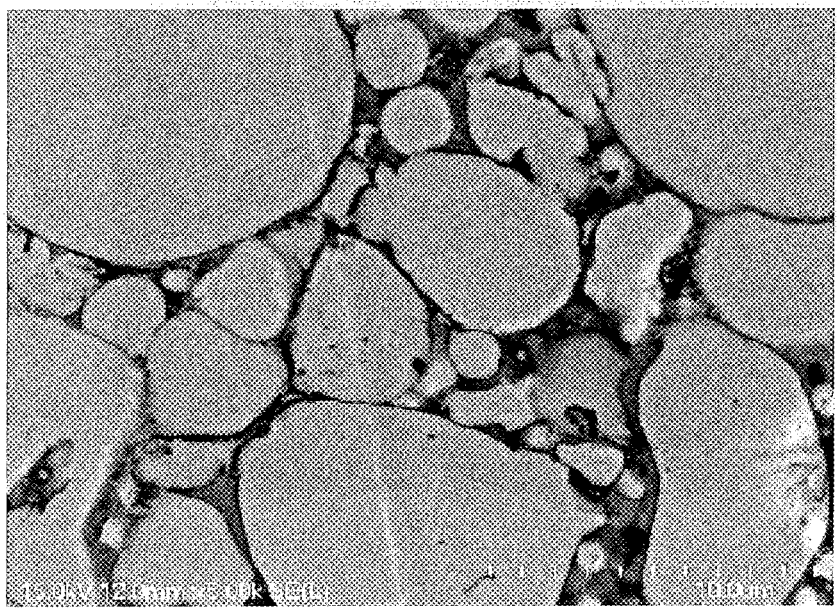
Figure 6:
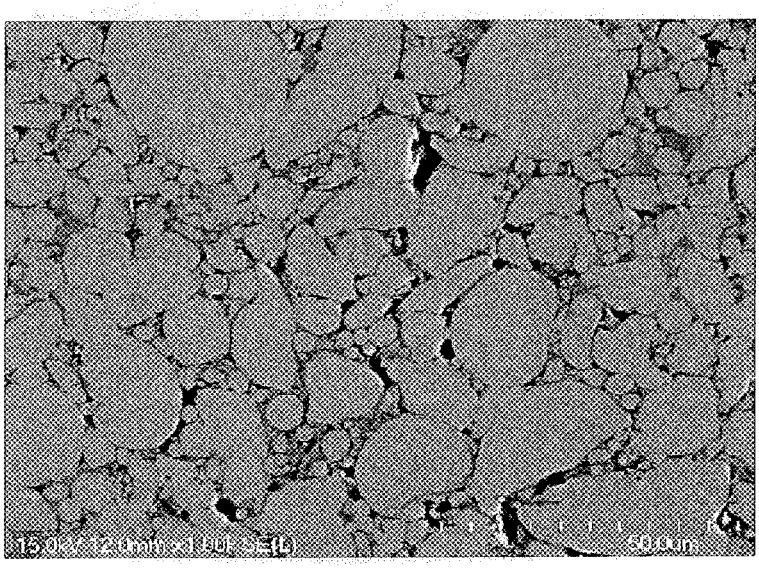
FIGS. 6(*a*) and 6(*b*) are SEM photographs obtained by observing a cross section of a magnetic core of Working Example 2.
Figure 6:
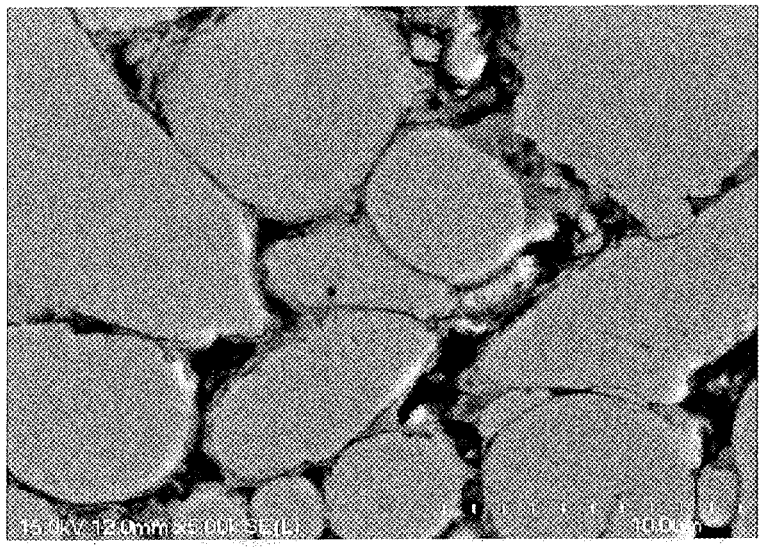
Figure 7:
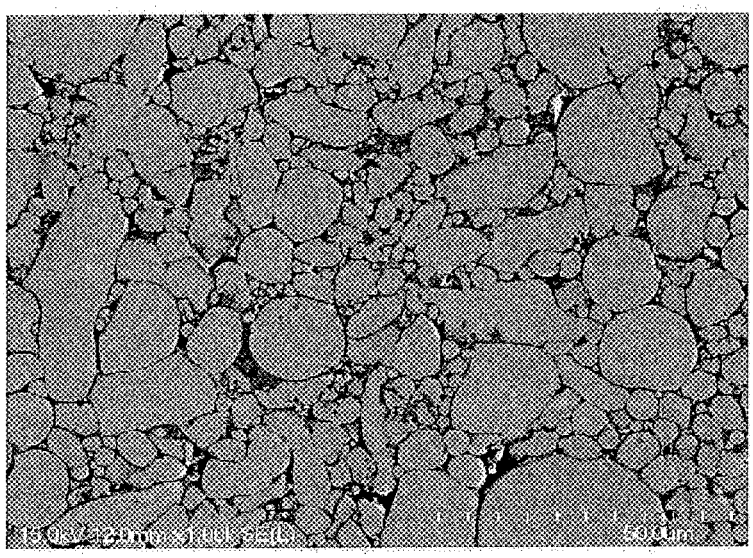
FIGS. 7(*a*) and 7(*b*) are SEM photographs obtained by observing a cross section of a magnetic core of Comparative Example 1.
Figure 7:
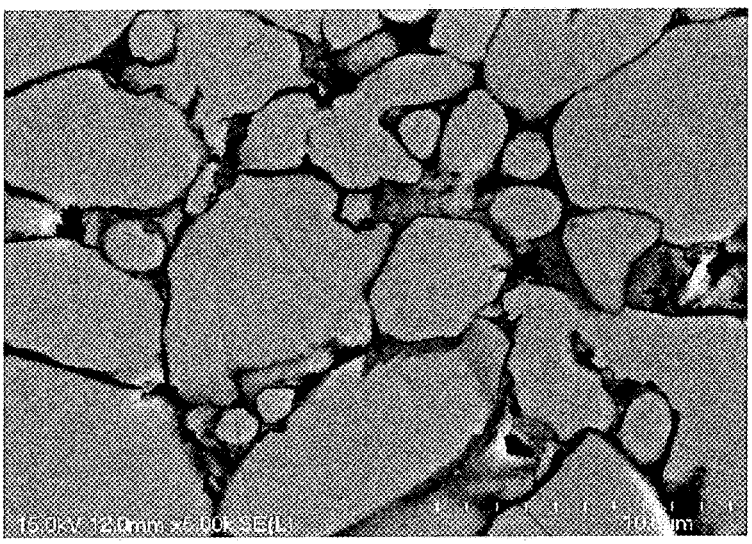
Figure 8:
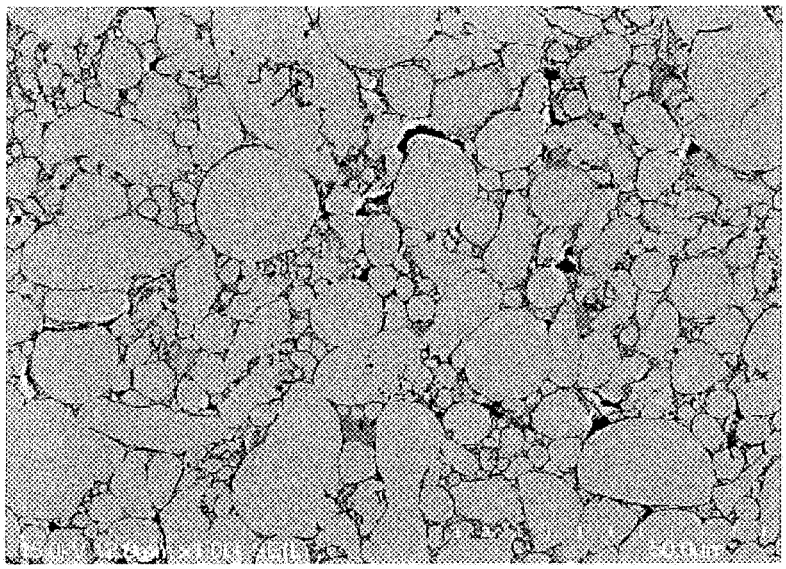
FIGS. 8(*a*) and 8(*b*) are SEM photographs obtained by observing a cross section of a magnetic core of Working Example 3.
Figure 8:
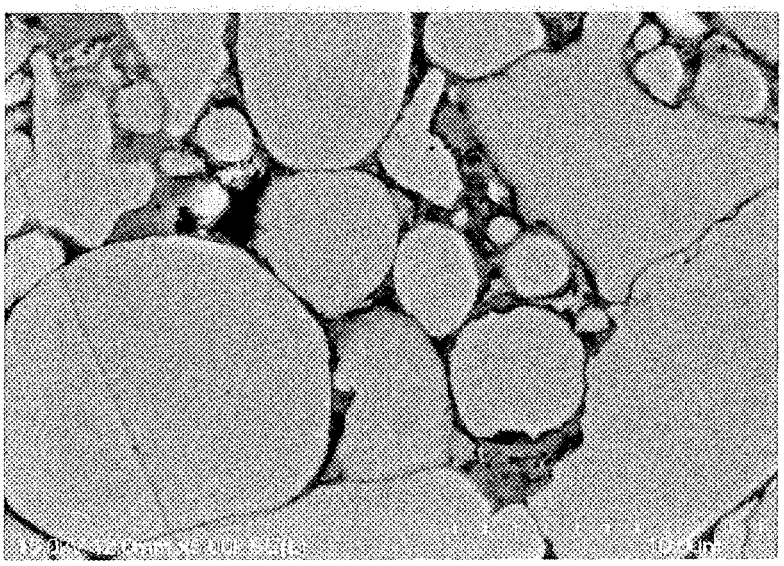

A coil component illustrated in FIG. 3 has a rectangular-flange-form magnetic core 1 having a body 60 between a pair of flanges 50*a* and 50*b* to be integrated with the flanges. Two terminal electrodes 70 are formed on a surface of one 50*a* of the two flanges. The terminal electrodes 70 are formed by printing and baking a silver conductor paste directly onto the surface of the magnetic core 1. A coil made of a wound line 80 that is an enamel conductive line is arranged around the body 60, an illustration of this situation being omitted. Both ends of the wound line 80 are connected to the terminal electrodes 70, respectively, by thermo-compression bonding, so that a surface-mount-type coil component such as a choke coil is formed. In the present embodiment, the flange surface on which the terminal electrodes 70 are formed is rendered a surface to be mounted onto a circuit board.

The magnetic core 1 is high in specific resistance. This matter makes it possible to lay the conductive line directly onto the magnetic core 1 without using a resin case (also referred to as a bobbin) for insulation and further form, onto the outer surface of the magnetic core, the terminal electrodes 70 to which the wound line is connected, so that the coil component can be made small in size. Moreover, the coil component can be made low in mount-height, and can further gain a stable mountability. From this viewpoint, the specific resistance of the magnetic core is preferably $1\times10^3$ Ω·m or more, more preferably $1\times10^5$ Ω·m or more. A high strength of the magnetic core 1 does not easily cause a breakage of the flange 50*a* or 50*b*, or the body 60 even when an external force acts thereto at the time of winding the conductive line onto the circumference of the body 60. Thus, the coil component is excellent in practicability. From this viewpoint, the radial crushing strength of the magnetic core is preferably 120 MPa or more, more preferably 200 MPa or more, even more preferably 250 MPa or more.

A method for manufacturing this magnetic core includes the step of mixing a binder with Fe-based soft magnetic alloy grains including M1 (wherein M1 represents both elements of Al and Cr), Si, and R (wherein R represents at least one element selected from the group consisting of Y, Zr, Nb, La, Hf and Ta) to yield a mixed powder (first step); the step of subjecting the mixed powder to pressing to yield a compact (second step); and the step of subjecting the compact to heat treatment in an atmosphere including oxygen to yield a magnetic core having a structure including alloy phases including the Fe-based soft magnetic alloy grains (third step). By this heat treatment, the grain boundary phase 30 is formed, through which any adjacent two of the alloy phases 20 are connected to each other, as shown in FIG. 2. Simultaneously, in the grain boundary phase 30, an oxide region is produced which includes Fe, M1, Si and R, and further includes Al in a larger proportion by mass than the alloy phase 20. In the oxide region, the ratio of the quantity of Al to the sum of the quantities of Fe, Al, Cr, Si and R is higher than in respective inner parts of the alloy phases 20.

In the first step, Fe-based soft magnetic alloy grains are used which include Al in a proportion of 3 to 10% both inclusive by mass, Cr in a proportion of 3 to 10% both inclusive by mass, Si in a proportion of 1% or less by mass, and R in a proportion of 0.01 to 1% both inclusive by mass;

and including Fe and inevitable impurities as the balance of the grains. A more preferred composition and others of the Fe-based soft magnetic alloy grains are as described above. Thus, any overlapped description thereabout is omitted.

The Fe-based soft magnetic alloy grains preferably have an average grain diameter of 1 to 100 μm as a median diameter d50 in a cumulative grain size distribution thereof. When the grains have such a small grain diameter, the magnetic core can be improved in strength, and is decreased in eddy current loss to be improved in magnetic core loss. In order to improve the magnetic core in strength, magnetic core loss and high-frequency property, the median diameter d50 is more preferably 30 μm or less, even more preferably 20 μm or less. In the meantime, if the grain diameter is too small, the magnetic core is easily lowered in magnetic permeability. Thus, the median diameter d50 is preferably 5 μm or more.

For the production of the Fe-based soft magnetic alloy grains, it is preferred to use an atomizing method (such as a water atomizing or gas atomizing method), which is suitable for producing substantially spherical alloy grains, which are high in malleability and ductility not to be easily crushed. Particularly preferred is a water atomizing method, by which fine alloy grains can be efficiently produced. The water atomizing method makes it possible to melt a crude raw material weighed to give a predetermined alloy composition in a high frequency heating furnace, or melt an alloy ingot produced beforehand into an alloy composition in a high frequency heating furnace, and then cause the hot melt (melted metal) to collide with water sprayed at a high speed and a high pressure, thereby making the metal into fine grains and simultaneously cooling the metal to yield the Fe-based soft magnetic alloy grains.

On the surface of the alloy grains yielded by the water atomizing method (water atomized powder), a naturally oxidized coat film made mainly of $Al_2O_3$, which is an oxide of Al, is formed into a thickness of about 5 to 20 nm. This naturally oxidized coat film contains Fe, Cr, Si and R besides Al. R, which is not particularly dissolved with ease in Fe into a solid solution, is present inside this naturally oxidized coat film at a higher concentration than inside the alloy grains. Moreover, island-form oxides made mainly of Fe oxides may be further formed on the surface side of this naturally oxidized coat film (on the outermost surface side of the whole of each of the alloy grains). This island-form oxides contains Al, Cr, Si and R besides Fe.

When the naturally oxidized coat film is formed on the surface of the alloy grains, the grains can obtain a rust-preventing effect, so that the grains can be prevented from being uselessly oxidized up to a time when the Fe-based soft magnetic alloy grains are heat-treated. Thus, the Fe-based soft magnetic alloy grains can also be stored in the air atmosphere. In the meantime, if the oxidized coat film becomes thick, the alloy grains become hard so that the grains may be damaged in shapability. For example, the water atomized powder just after the water atomizing is in a wet state with water. It is therefore preferred, at the time when the powder needs to be dried, to set the drying temperature (for example, the internal temperature of a drying furnace therefor) to 150° C. or lower.

The grain diameter of the resultant Fe-based soft magnetic alloy grains has a distribution. Accordingly, when the grains are filled into a die, large gaps are formed between grains large in grain diameter, out of the grains, so that the filling factor thereof is not raised to tend to lower the density of the compact yielded by pressing. It is therefore preferred to classify the resultant Fe-based soft magnetic alloy grains to remove the grains large in grain diameter. The method for the classification may be any drying classification, such as classification with a sieve. It is preferred to yield alloy grains having at largest a grain diameter smaller than 32 μm (i.e., grains that have passed through a sieve having a sieve opening size of 32 μm).

A binder to be blended into the Fe-based soft magnetic alloy grains allows the alloy grains to be bonded to each other in the pressing, and give the compact such a strength that this compact can resist against any handling of the compact after the forming. A mixed powder of the Fe-based soft magnetic alloy grains and the binder is preferably granulated into a granule. This case makes it possible to improve the granule in fluidity and fillability inside the die. The kind of the binder is not particularly limited, and may be, for example, an organic binder such as polyethylene, polyvinyl alcohol or acrylic resin. It is allowable to use the binder together with an inorganic binder, which remains after the heat treatment. However, the grain boundary phase produced in the third step produces an effect of binding the alloy grains to each other; thus, it is preferred to omit any inorganic binder to make the process simple.

It is sufficient for the addition amount of the binder to permit the binder to spread sufficiently between the Fe-based soft magnetic alloy grains to ensure the strength of the resultant compact sufficiently. However, if the addition amount of the binder is too large, the compact tends to be lowered in density and strength. From this viewpoint, the addition amount of the binder is set into a range preferably from 0.2 to 10 parts by weight, more preferably from 0.5 to 3.0 parts by weight for 100 parts by weight of the Fe-based soft magnetic alloy grains.

The method for mixing the binder with the Fe-based soft magnetic alloy grains is not particularly limited. Thus, a mixing method or mixer known in the prior art may be used. The granulating method may be, for example, rolling granulation, or any wet granulating method such as spray drying granulation. Out of such examples, spray drying granulation using a spray drier is preferred. This method makes it possible to make the shape of the granule close to a sphere, and shorten a period when the granule is exposed to heated air to give a large quantity of the granule.

The resultant granule preferably has a bulk density of 1.5 to $2.5\times10^3$ kg/m$^3$ and an average grain diameter (d50) of 60 to 150 μm. Such a granule is excellent in fluidity when made into a shape, and further makes the gap between alloy grains thereof small to be increased in fillability into the die. As a result, the compact becomes high in bulk density to yield a magnetic core high in magnetic permeability. In order to obtain a desired granule diameter, classification with, for example, a vibrating sieve is usable.

In order to decrease the friction between the mixed powder (granule) and the die in the pressing, it is preferred to add a lubricant such as stearic acid or a stearate to the grains. The addition amount of the lubricant is set into a range preferably from 0.1 to 2.0 parts by weight for 100 parts by weight of the Fe-based soft magnetic alloy grains. The lubricant may be applied to the die.

In the second step, the mixed powder of the Fe-based soft magnetic alloy grains and the binder is preferably granulated as described above, and subjected to pressing. In the pressing, the mixed powder is formed into a predetermined shape such as a toroidal shape or a rectangular parallelepiped shape, using a press machine such as a hydraulic press machine or servo press machine, and die. This pressing may be pressing at room temperature, or hot pressing, in which the granule is heated at a temperature that does not permit the binder to be lost and that is near to the glass transition temperature of the binder, which permits the binder to be softened, in accordance with the material of the binder. The fluidity of the granule inside the die can be improved by the shape of the Fe-based soft magnetic alloy grains, the shape of the granule, the selection of the average grain diameter of the grains and/or that of the granule, and the effect of the binder and the lubricant.

In the compact yielded by the pressing, the Fe-based soft magnetic alloy grains are brought into point contact or surface contact with each other to interpose the binder or the naturally oxidized coat film therebetween. In this way, the grains are made adjacent to each other to interpose voids partially therebetween. Even when the Fe-based soft magnetic alloy grains are pressed under a low pressure of 1 GPa or less, the compact can gain a sufficiently large compact density and radial crushing strength. By such a low-pressing, the following decrease can be attained: a decrease of breakages of the naturally oxidized coat film, which is formed on the surface of the Fe-based soft magnetic alloy grains and contains Al. Consequently, the corrosion resistance of the compact is heightened. The density of the compact is preferably $5.6\times10^3$ kg/m$^3$ or more. The radial crushing strength of the compact is preferably 3 MPa or more.

In the third step, the compact is subjected to annealing as a heat treatment to gain good magnetic properties by a relief of stress strains introduced into the compact by the pressing. By this annealing, the grain boundary phase 30 is formed, though which any adjacent two of the alloy phases 20 are connected to each other, and further in the grain boundary phase 30 an oxide region is produced in which Fe, M1 and R are included and further Al is included in a larger proportion by mass than in the alloy phases 20. The organic binder is thermally discomposed and lost by the annealing. Since the oxide region is produced in this way by the heat treatment after the pressing, a magnetic core excellent in strength and others can be manufactured by a simple method without using any insulator such as glass.

The annealing is performed in an oxygen-containing atmosphere, such as the air atmosphere, a mixed gas of oxygen and an inert gas, or an atmosphere containing water vapor. The heat treatment in the air atmosphere is preferred since the treatment is simple. As has been already described, the oxide region is obtained by reaction between the Fe-based soft magnetic alloy grains and oxygen in the heat treatment, and is produced by an oxidization reaction which exceeds natural oxidization of the Fe-based soft magnetic alloy grains. The production of this oxide region gives a magnetic core excellent in insulating property and corrosion resistance, and high in strength, in which a large number of the Fe-based soft magnetic alloy grains are strongly bonded to each other.

In the magnetic core obtained via the heat treatment, the space factor ranges preferably from 82 to 90%. This case makes it possible to heighten the space factor to improve the core in magnetic properties while loads to facilities and costs are restrained.

After the annealing, a cross section of the magnetic core is observed, using a scanning electron microscope (SEM) and the distribution of each of the constituting elements is examined by energy dispersive X-ray spectroscopy (EDX). In this case, it is observed that Al is concentrated in the grain boundary phase 30. Furthermore, when a cross section of the magnetic core is observed using a transmission electron microscope (TEM), an oxide region showing a lamellar structure as illustrated in FIG. 2 is observed.

Furthermore, when the composition of the magnetic core is analyzed in detail by EDX using a transmission electron microscope (TEM), it is observed that the grain boundary phase 30 contains Fe, Al, Cr, Si and R. Additionally, in the edge part 30*c* of the oxide region, which is near the alloy phases 20, an R-including oxide makes its appearance along the interface between the alloy phases 20 and the grain boundary phase 30. Moreover, in regions of the grain boundary phase 30 except the island-regions, which will be detailed later, the ratio of the quantity of Al to the sum of the quantities of Fe, Al, Cr and R is higher than the ratio of the quantity of each of Fe, Cr, Si and R thereto. The regions correspond to the "first region" and the "third region". The "third region" is higher in proportion of R than the "first region". This oxide region has the region higher in proportion of R (third region) than any other region (first region) in the oxide region. In region making its appearance in the form of islands inside the oxide region, the ratio of the quantity of Fe to the sum of the quantities of Fe, Al, Cr and R is higher than the ratio of the quantity of each of Al, Cr and R thereto. This region corresponds to the "second region".

In order to relieve stress strains in the compact and produce the oxide region in the grain boundary phase 30, the annealing temperature is preferably a temperature permitting the compact to have a temperature of 600° C. or higher. The annealing temperature is also preferably a temperature permitting the compact to have a temperature of 850° C. or lower to avoid a matter that the grain boundary phase 30 is partially lost, denatured or damaged in any other manner to lower the compact in insulating property, or the compact is remarkably advancingly sintered so that the alloy phases directly contact each other to increase portions where these phases are partially connected to each other (necked portions), whereby the magnetic core is lowered in specific resistance to be increased in eddy current loss. From this viewpoint, the annealing temperature is more preferably from 650 to 830° C., even more preferably from 700 to 800° C. The period when the compact is kept at this annealing temperature is appropriately set in accordance with the size of the magnetic core, the treating quantity of such magnetic cores, a range in which a variation in properties thereof is permitted, and others. The period is set, for example, into a range of 0.5 to 3 hours. The necked portions are permitted to be partially formed unless an especial hindrance is given to the specific resistance or magnetic core loss.

If the thickness of the grain boundary phase 30 is too large, the interval between the alloy phases is widened to make the magnetic core low in magnetic permeability and large in hysteresis loss, and the proportion of the oxide region containing nonmagnetic oxides may be increased to make the magnetic core low in saturation magnetic flux density. Thus, the average thickness of the grain boundary phase 30 is preferably 100 nm or less, more preferably 80 nm or less. In the meantime, if the thickness of the grain boundary phase 30 is too small, a tunnel current flowing into the grain boundary phase 30 may increase an eddy current loss. Thus, the average thickness of the grain boundary phase 30 is preferably 10 nm or more, more preferably 30 nm or more. The average thickness of the grain boundary phase 30 is calculated out by: observing a cross section of the magnetic core through a transmission electron microscope (TEM) at a magnifying power of 600,000 or more; measuring, in a region where the contour of alloy phases is identified inside the observed vision field, the thickness of a portion where the alloy phases are made closest to each other (minimum thickness), and that of a portion where the alloy phases are made farthest from each other (maximum thickness); and then making the arithmetic average of the two.

In order to improve the magnetic core in strength and high frequency properties, the average of the respective maximum diameters of the granular alloy phases is preferably 15 μm or less, more preferably 8 μm or less. In the meantime, in order to restrain a fall in the magnetic permeability, the average of the respective maximum diameters of the alloy phases is preferably 0.5 μm or more. The average of the maximum diameters is calculated out by polishing a cross section of the magnetic core, observing the section through a microscope, reading out the respective maximum diameters of 30 or more out of grains presenting inside the vision field having a predetermined area, and then calculating the number-average diameter thereof. The Fe-based soft magnetic alloy grains after the pressing are plastically deformed; according to the cross section observation, almost all of the alloy phases are each naked in a cross section of a part of the alloy phase that is different from a central part of this phase, so that the above-mentioned average of the maximum diameters is a value smaller than the median diameter d50 estimated when the grains are in the powder state.

In order to improve the magnetic core in strength and high frequency properties, it is preferred in an observation image of a cross section of the magnetic core through SEM at a magnifying power of 1,000 that the abundance ratio of alloy phases having a maximum diameter of 40 μm or more is 1% or less. This abundance ratio is a value obtained by measuring the number K1 of all alloy phases, each of which are surrounded by grain boundaries, inside the observed vision field with at least 0.04 $mm^2$ or more, and the number K2 of alloy phases having a maximum diameter of 40 μm or more, out of these phases; dividing K2/K1, and representing the resultant value in the unit of percent. The measurement of K1 and K2 are made under a condition that alloy phases having a maximum diameter of 1 μm or more are targets. The magnetic core is improved in frequency properties by making the Fe-based soft magnetic alloy grains fine, these grains constituting this core.

EXAMPLES OF FIRST ASPECT

A description will be specifically made about (working) examples of the first aspect of the present invention. Initially, into a crucible were charged each Fe—Al—Cr alloy ingot, and a predetermined quantity of Zr and/or Ti (the purity of each of the two was 99.8% or more). The mixture was melted by high frequencies in the atmosphere of Ar, and then produced into an alloy powder by a water atomizing method. Next, the produced alloy powder was passed through a sieve with a 440-mesh (sieve opening size: 32 μm) to remove coarse grains. The method for the melting may be a method of using raw materials of Fe, Al and Cr to be melted. An atomizing method to be used is not limited to the water atomizing method, and may be, for example, a gas atomizing method. In this way, each powder was yielded. The composition-analyzed result and the average grain diameter (median diameter d50) of the powder are shown in Table 2. The respective proportions of Al and Zr are each an analytic value obtained by ICP emission spectroscopy; the proportion of Cr, a value obtained by a capacitance method; and those of Si and Ti, a value obtained by absorption photometry. Other elements of R are also measured by ICP emission spectroscopy. The average grain diameter is a value measured by a laser diffraction scattering grain-size-distribution measuring device (LA-920, manufactured by Horiba Ltd.). These Fe-based soft magnetic alloy grain species were each used to manufacture a magnetic core through steps (1) to (3) described below. The resultant magnetic cores were called Reference Example 1, Comparative Example 1 and Working Examples 1 to 5, respectively.

TABLE 2

| Alloy grains | Al (% by mass) | Cr (% by mass) | Si (% by mass) | Zr (% by mass) | Ti (% by mass) | Fe | d50 (μm) |
|---|---|---|---|---|---|---|---|
| No.1 | 4.92 | 3.89 | 0.20 | — | — | bal. | 15.3 |
| No.2 | 5.04 | 3.87 | 0.20 | 0.30 | — | bal. | 12.4 |
| No.3 | 4.96 | 3.86 | 0.20 | 0.57 | — | bal. | 13.8 |
| No.4 | 5.02 | 3.85 | 0.20 | — | 0.29 | bal. | 13.1 |
| No.5 | 4.95 | 3.78 | 0.20 | 0.29 | 0.30 | bal. | 11.4 |
| No.6 | 4.88 | 3.87 | 0.20 | 0.88 | — | bal. | 12.5 |
| No.7 | 4.92 | 3.91 | 0.20 | 0.09 | — | bal. | 11.5 |

(1) Mixing

An agitating crusher was used to add, to 100 parts by weight of each of the Fe-based soft magnetic alloy grain species, 2.5 parts by weight of a PVA (POVAL PVA-205, manufactured by Kuraray Co., Ltd.; solid content: 10%) as a binder, and then mix these components. The resultant mixture was dried at 120° C. for 10 hours, and then passed through a sieve to yield a granule of the mixed powder. The average grain diameter (d50) thereof was set into the range of 60 to 80 μm. Moreover, 0.4 part by weight of zinc stearate was added to 100 parts by weight of the granule. A container-rotating/vibrating type powder mixer was used to mix the components with each other to yield a mixed powder granule to be pressed.

(2) Pressing

The resultant granule was supplied into a die. A hydraulic press machine was used to subject the granule to pressing at room temperature. The pressure was set to 0.74 GPa. The resultant compact was a toroidal ring having an internal diameter of 7.8 mm, an external diameter of 13.5 mm, and a thickness of 4.3 mm.

(3) Heat Treatment

The resultant compact was annealed in the air atmosphere inside an electrical furnace to yield a magnetic core having the following typical sizes: an internal diameter of 7.7 mm, an external diameter of 13.4 mm, and a thickness of 4.3 mm. In the heat treatment, the temperature of the compact was raised from room temperature to an annealing temperature of 750° C. at a rate of 2° C./minute. At the annealing temperature, the compact was kept for 1 hour, and cooled in the furnace. In order to decompose the binder and other organic substances added at the time of the granulation, a degreasing step of keeping the compact at 450° C. for 1 hour was incorporated into the middle of the heat treatment.

About each of the compacts yielded as described, and the magnetic cores, properties in the following items (A) to (G) were evaluated:

(A) Density dg of Compact, and Density ds Thereof After Annealing

About each of the ring-form compact and the magnetic core, the density ($kg/m^3$) thereof was calculated from the dimensions and the mass thereof by the volume and weight method. The resultant values were defined as the density dg of the compact and the density ds thereof after the annealing, respectively.

(B) Space Factor (Relative Density)

The calculated density ds after the annealing was divided by the true density of the soft magnetic alloy to calculate out the space factor (relative density) [%] of the magnetic core. The true density was gained by the volume and weight method applied to an ingot of the soft magnetic alloy that was beforehand yielded by casting.

(C) Magnetic Core Loss Pcv

The ring-form magnetic core was used as a sample to be measured, and a primary side winding line and a secondary side winding line were each wound into 15 turns. A B—H analyzer, SY-8232, manufactured by Iwatsu Test Instruments Corp. was used to measure the magnetic core loss ($kW/m^3$) at room temperature under conditions of a maximum magnetic flux density of 30 mT and frequencies from 50 to 1000 kHz.

(D) Initial Permeability μi

The ring-form magnetic core was used as a sample to be measured, and a conductive line was wound into 30 turns. An LCR meter (4284A, manufactured by Agilent Technologies, Inc.) was used to measure the inductance L at room temperature and a frequency of 100 kHz. The initial permeability μi thereof was gained in accordance with the following equation:

Initial permeability $\mu i=(le\times L)/(\mu_0\times Ae\times N^2)$ wherein le: the magnetic path length (m), L: the inductance (H) of the sample, $\mu_0$: the magnetic permeability of vacuum=$4\pi\times10^{-7}$ (H/m), Ae: the sectional area ($m^2$) of the magnetic core, and N: the number of the turns of the coil.

(E) Incremental Permeability $\mu_\Delta$

The ring-form magnetic core was used as a sample to be measured, and a conductive line was wound into 30 turns. The LCR meter (4284A, manufactured by Agilent Technologies, Inc.) was used to measure the inductance L at room temperature and a frequency of 100 kHz in the state of applying a DC magnetic field of 10 kA/m to the coil. In the same way as used to gain the initial permeability μi, the incremental permeability $\mu_\Delta$ was gained.

(F) Radial Crushing Strength σr

The ring-form magnetic core as a sample to be measured was arranged between surface plates of a tension/compression tester (Autograph AG-1, manufactured by Shimadzu Corp.) in accordance with JIS Z 2507. A load was applied to the magnetic core from the radial direction thereof to measure a maximum load P (N) given when the core was broken. The radial crushing strength σr (MPa) thereof was gained in accordance with the following equation:

$$\text{Radial crushing strength } \sigma r \text{ (MPa)}=P(D-d)/(1d^2)$$

wherein D: the external diameter (mm) of the magnetic core, d: the thickness (mm) of the magnetic core [½ of the difference between the internal and external diameters], and 1: the height (mm) of the magnetic core.

(G) Specific Resistance ρ (Electric Resistivity)

A conductive adhesive was applied onto two flat planes of the magnetic core as a sample to be measured, these planes being opposed to each other. After the adhesive was dried and solidified, the magnetic core was set between electrodes. An electric resistance measuring instrument (8340A, manufactured by ADC Corp.) was used to apply a DC voltage of 50 V to the magnetic core to measure the resistance value R (Ω) thereof. The specific resistance ρ(Ω·m) of the core was calculated out in accordance with the following equation:

$$\text{Specific resistance } \rho \text{ (}\Omega\cdot\text{m)=resistance value } R\times(A/t)$$

wherein A: the area ($m^2$) of any one of the flat planes of the magnetic core [electrode area]; and t: the thickness (m) of the magnetic core [distance between the electrodes].

In Table 3 are shown evaluation results of the above-mentioned properties of the magnetic core of each of Reference Example 1, Comparative Example 1, and Working Examples 1 to 5.

TABLE 3

| | Alloy grains | Compact density dg ($\times10^3$ $kg/m^3$) | Density ds after annealing ($\times10^3$ $kg/m^3$) | Space factor (%) | Magnetic core loss Pcv ($kW/m^3$) 50 kHz | 100 kHz | 300 kHz | 500 kHz | 1000 kHz | Initial permeability μi | Incremental permeability $\mu_\Delta$ | Radial crushing strength (MPa) | Specific resistance ($\times10^3$ Ω · m) |
|---|---|---|---|---|---|---|---|---|---|---|---|---|---|
| Reference Example 1 | No.1 | 6.23 | 6.39 | 87.9 | 66 | 140 | 461 | 832 | 1911 | 60.7 | 23.0 | 211 | 12.0 |
| Working Example 1 | No.2 | 6.10 | 6.30 | 86.6 | 117 | 222 | 681 | 1201 | 2626 | 38.3 | 21.7 | 289 | 330.0 |
| Working Example 2 | No.3 | 6.10 | 6.27 | 86.2 | 112 | 217 | 664 | 1163 | 2528 | 34.8 | 21.1 | 289 | 480.0 |
| Comparative Example 1 | No.4 | 6.19 | 6.37 | 87.6 | 85 | 177 | 571 | 1023 | 2373 | 48.9 | 22.7 | 319 | 0 |
| Working Example 3 | No.5 | 6.07 | 6.23 | 85.6 | 105 | 198 | 615 | 1070 | 2336 | 38.1 | 21.8 | 288 | 4.2 |
| Working Example 4 | No.6 | 6.02 | 6.23 | 85.7 | 113 | 228 | 691 | 1212 | 2365 | 28.4 | 19.3 | 281 | 220.0 |
| Working Example 5 | No.7 | 6.18 | 6.41 | 88.1 | 92 | 195 | 609 | 1085 | 2391 | 40.7 | 21.9 | 315 | Not measured |

As shown in Table 3, Working Examples 1, 2 and 4, which included Zr, were made largely better in specific resistance than Reference Example 1, and each gave an excellent specific resistance of $1\times10^5$ Ω·m or more. By contrast, Comparative Example 1, which included no Zr and included Ti, did not exhibit insulating property. It can be considered that Comparative Example 1 was lowered in specific resistance by the incorporation of Ti. However, Working Example 3, which included Ti in the same proportion as in Comparative Example 1, was improved in specific resistance by the incorporation of Zr, and gave a specific resistance of $1\times10^3$ Ω·m or more.

Between the examples, no remarkable difference was observed in magnetic core density. However, Working Examples 1 to 5, which included Zr, were made better in radial crushing strength than Reference Example 1, and each gave a radial crushing strength more than 250 MPa. Although Working Examples 1 to 5 were poorer in magnetic core loss and initial permeability than Reference Example 1, the magnetic core loss thereof was 691 $kW/m^3$ or less at 300 kHz and the initial permeability thereof was more than 20. These properties were each at a level giving no hindrance to the practical use of the magnetic cores. Additionally, between the examples, no remarkable difference was observed in incremental permeability. Thus, it can be stated that Working Examples 1 to 5 also ensure DC superimposition characteristics.

About these magnetic cores, a scanning electron microscope (SEM/EDX) was used to observe their cross section. Simultaneously, the distribution of their individual constituting elements was examined. FIGS. 4 to 8 are each an SEM photograph obtained by observing a cross section of the magnetic core of each of the examples. The photograph of each of FIGS. (b) is a photograph obtained by enlarging and photographing the cross section around the same observed point as observed for the corresponding FIG. (a). Their portions high in brightness are Fe-based soft magnetic alloy grains, and portions low in brightness that are formed on the surface of the grains are grain boundary portions or void portions. In a comparison between the cross sections of the individual examples, no remarkable difference was verified.

Figure 9:
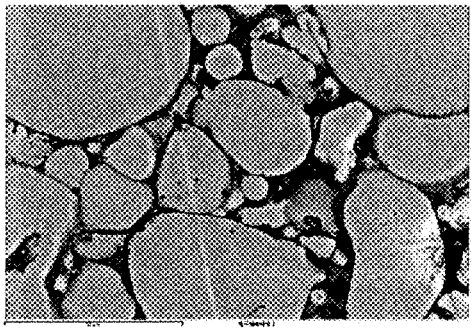
FIGS. 9(*a*) to 9(*f*) are an SEM photograph and mapping diagrams obtained by observing a cross section of a magnetic core of Working Example 1.
Figure 9:
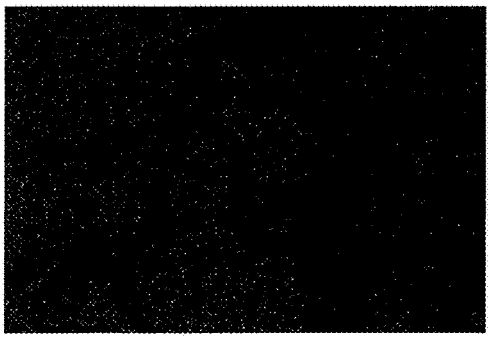
Figure 9:
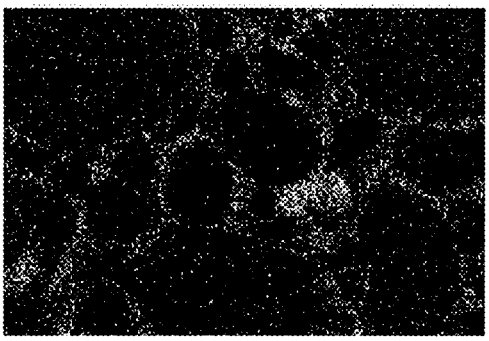
Figure 9:
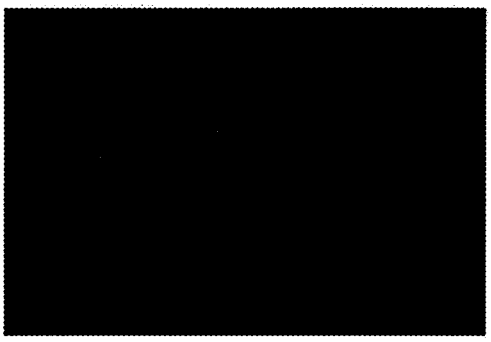
Figure 9:
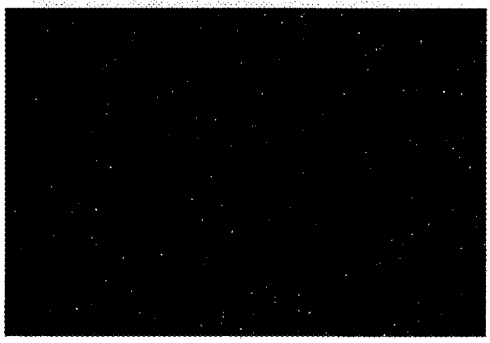
Figure 9:
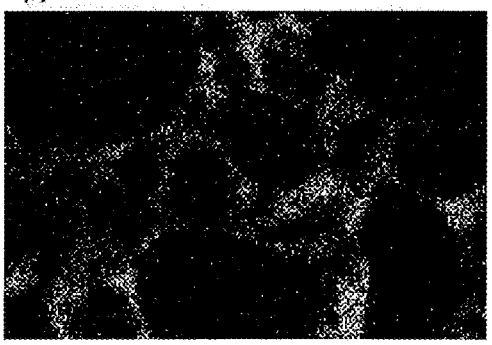
Figure 10:
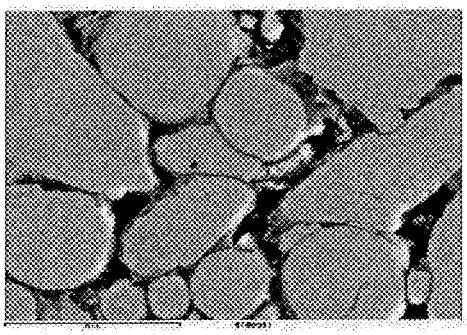
FIGS. 10(*a*) to 10(*f*) are an SEM photograph and mapping diagrams obtained by observing a cross section of a magnetic core of Working Example 2.
Figure 10:
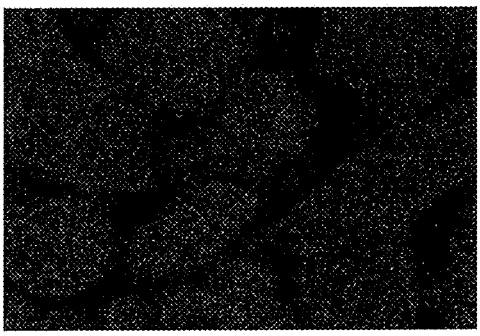
Figure 10:
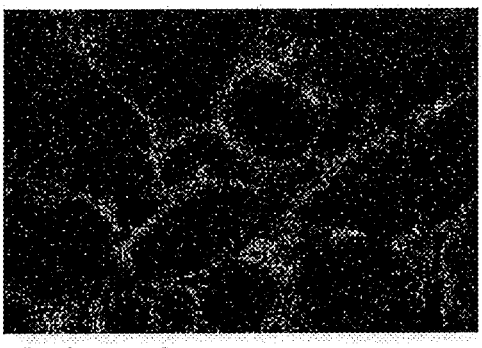
Figure 10:
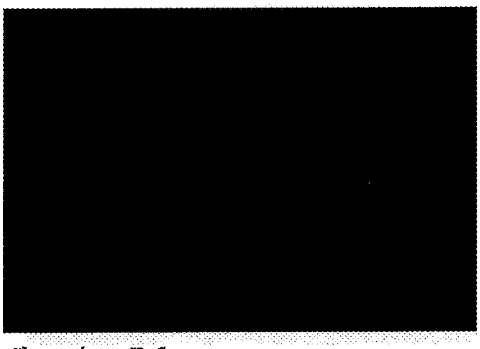
Figure 10:
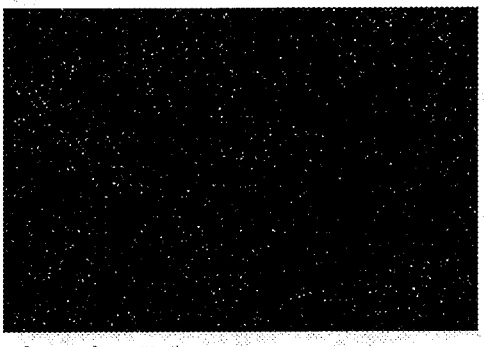
Figure 10:
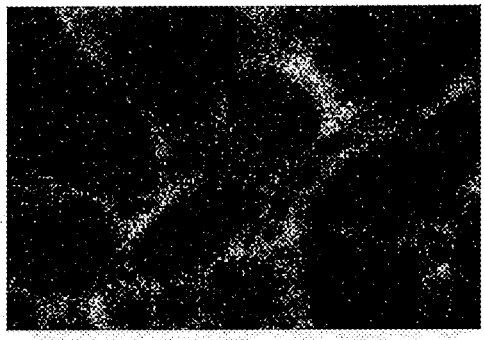

FIG. 9 are an SEM photograph obtained by observing a cross section of the magnetic core of Working Example 1, and mapping views each showing an element distribution in a vision field corresponding thereto; and FIG. 10 are the same as about Working Example 2. The mapping views of FIGS. 9(*b*) to 9(*f*) or FIGS. 10(*b*) to 10(*f*) show the distributions of Fe, Al, Cr, Zr and O, respectively. As each of the views has a brighter color tone, the target element is larger in proportion. In each of Working Examples 1 and 2, the following is observed: the concentration of Al is higher in the grain boundary phase between the alloy phases; moreover, O is also large in proportion so that oxides are produced; and any adjacent the alloy phases are bonded to each other to interpose the grain boundary phase therebetween. In the grain boundary phase, the concentration of Fe is lower than in the alloy phases. It is not observed that Cr and Zr each have a large concentration distribution.

Figure 11:
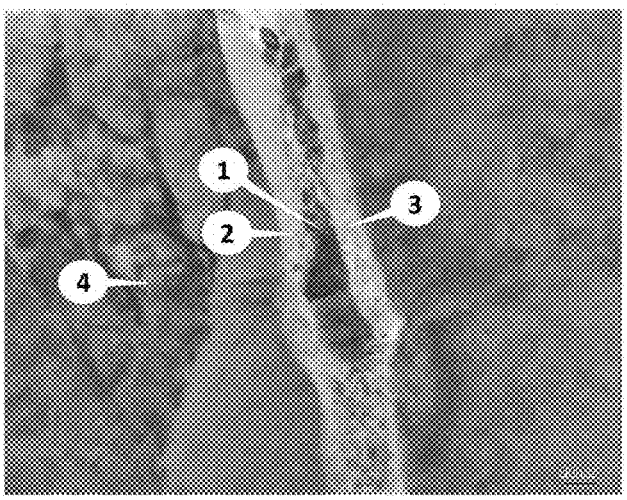
FIG. 11 is a TEM photograph obtained by observing a cross section of a magnetic core of Reference Example 1.
Figure 12:
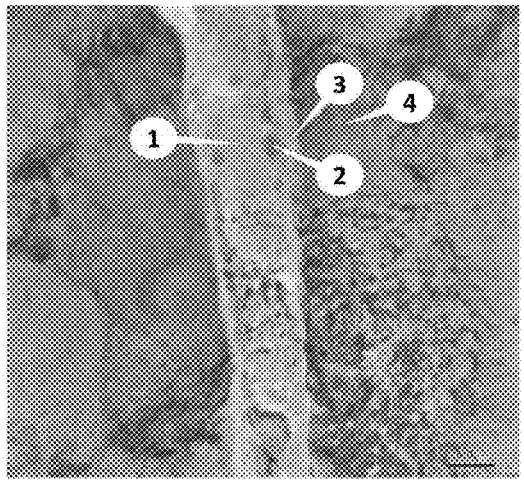
FIG. 12 is a TEM photograph obtained by observing a cross section of a magnetic core of Working Example 1.

FIG. 11 is a TEM photograph obtained by observing a cross section of the magnetic core of Reference Example 1 at a magnifying power of 600,000 or more through a transmission electron microscope (TEM), and shows a portion where the contour of respective cross sections of two grains in the alloy phases made of Fe-based soft magnetic alloy grains was verified; and FIG. 12 is the same as about Working Example 1. In each of these TEM photographs, a band portion extending in a vertical direction is the grain boundary phase. Portions which are positioned adjacently to each other across the grain boundary phase and are lower in brightness than the grain boundary phase are two of the alloy phases.

As shown in FIG. 11, in Reference Example 1, portions different from each other in color tone were verified in a central part of the grain boundary phase and in an edge part of the grain boundary phase that is near the alloy phases. A composition analysis by TEM-EDX was applied to a region having a diameter of 1 nm in each of the following: the central part of the grain boundary phase (central part of an oxide region: marker 1); any edge part of the grain boundary phase (edge part of the oxide region: markers 2 and 3); and the inside of one of the alloy phases (marker 4). The results are shown in Table 4. The edge part of the grain boundary phase was rendered a part which was near any one of the alloy phases and was extended to a position about 5 nm apart from the surface of the alloy grain making its appearance as the contour of the cross section.

TABLE 4

(% by mass)

| | | Marker | Fe | Al | Cr | Si | O |
|---|---|---|---|---|---|---|---|
| Oxide layer | Central part | 1 | 79.1 | 11.8 | 1.8 | 0.1 | 7.2 |
| | Edge part | 2 | 6.9 | 51.7 | 10.1 | 0.0 | 31.3 |
| | Edge part | 3 | 6.3 | 54.9 | 7.4 | 0.0 | 31.4 |
| Inside of alloy phase | | 4 | 92.6 | 2.9 | 4.2 | 0.3 | 0.0 |

As shown in Table 4, in Reference Example 1, in the grain boundary phase through which the adjacent alloy phases are connected to each other, the oxide region is produced, which includes Fe, Al and Cr and includes Al in a larger proportion than the alloy phases. Inside the oxide region having a high proportion of Al, in the oxide region edge parts along the interfaces between the alloy phases and the grain boundary phase, the proportion of Al is particularly high. A region having a high Fe proportion is produced into a band form to be sandwiched between the regions particularly high in Al proportion. In the grain boundary phase, Zn, which originates from zinc stearate added as the lubricant, is also identified. However, any description thereabout is omitted (the same as in Table 5).

As shown in FIG. 12, in Working Example 1, the color tone of the grain boundary phase is uniform as a whole. A composition analysis by TEM-EDX was applied to a region having a diameter of 1 nm in each of the following: a central part of the grain boundary phase (marker 1); an edge part of the grain boundary phase (edge part A: marker 3); an island-form portion low in brightness inside the edge part of the grain boundary phase (edge portion B: marker 2); and the inside of one of the alloy phases (marker 4). The results are shown in Table 5. The edge part A of the grain boundary phase was rendered a part which was near the alloy phase and was extended to a position about 5 nm apart from the surface of the alloy grain making its appearance as the contour of the cross section.

TABLE 5

(% by mass)

| | | Marker | Fe | Al | Cr | Si | Zr | O |
|---|---|---|---|---|---|---|---|---|
| Oxide layer | Central part | 1 | 12.8 | 53.1 | 2.6 | 0.0 | 0.0 | 31.5 |
| | Edge part B | 2 | 39.8 | 22.1 | 25.0 | 0.3 | 0.4 | 12.4 |
| | Edge part A | 3 | 15.1 | 48.1 | 3.8 | 0.5 | 2.3 | 30.2 |
| Inside of alloy phase | | 4 | 92.1 | 2.4 | 4.3 | 0.3 | 0.1 | 0.8 |

As shown in Table 5, in Working Example 1, the oxide region is produced in the grain boundary phase through which adjacent alloy phases are connected to each other, and the oxide region includes Fe, Al, Cr, Si and Zr, and includes Al in a larger proportion than the alloy phases. The proportion of Al is high not only in the edge part of each of the oxide regions but also in the central part of the oxide region, such a state being different from that shown in FIG. 11. Moreover, inside the edge part of the oxide region, in the edge part A near the interface between the alloy phases and the grain boundary phase, Zr is present in a larger proportion than in the alloy phases. The edge part A includes Zr in a proportion of 2% or more by mass. By contrast, in the center region of the oxide phase, Zr is hardly present. It can be considered that in such a way, oxides including Al and Zr cover the surface of the alloy phases, thereby restraining the diffusion of Fe at the time of the heat treatment of the alloy grains to improve the magnetic core in specific resistance.

In Working Example 1, in the central part of each of the oxide regions, and the edge part A thereof, the ratio of the quantity of Al to the sum of the quantities of Fe, Al, Cr, Si and Zr is higher than the ratio of the quantity of each of Fe, Cr, Si and Zr thereto. This region corresponds to the first region in the grain boundary phase. Moreover, the edge part A has a higher proportion of Zr than an edge portion B, and this corresponds to the third region. In the meantime, in the edge portion B of the oxide region, the ratio of the quantity of Fe to the sum of the quantities of Fe, Al, Cr, Si and Zr is higher than the ratio of the quantity of each of Al, Cr, Si and Zr thereto. Thus, this region corresponds to the second region in the grain boundary phase. It can be considered that the second region is surrounded by the first and third regions to be made into an inland form to be restrained from undergoing diffusion of Fe at the heat treatment time.

As Working Examples different from the above-mentioned Working Examples, magnetic cores were manufactured, using a spray drying granulating method as a granulating method. Various properties thereof were evaluated. In Table 6 are shown the composition of a raw material powder used in each of the present Working Examples, and the average grain diameter thereof. The raw material powder was used and subjected to the spray drying granulation under the following conditions: Initially, into a container of a stirring machine were charged soft magnetic alloy grains, a PVA (POVAL PVA-205, manufacture by Kuraray Co., Ltd.; solid content: 10%) as a binder, and ion exchange water as a solvent. These components were then stirred and mixed with each other to prepare a slurry. The slurry concentration was 80% by mass. The amount of the binder was set to 10 parts by weight for 100 parts by weight of the soft magnetic alloy grains. A spray drier was used to spray the slurry inside the machine, and the slurry was instantaneously dried with hot wind having a temperature adjusted to 240° C. to collect a granule made into a granular form from the lower part of the machine. In order to remove coarse grains of the resultant granule, the granule was passed through a 60-mesh (sieve opening size: 250 μm) sieve to adjust the average grain diameter of the granule passed through the sieve into the range of 60 to 80 μm. To 100 parts by weight of the resultant granule was added 0.4 part by weight of zinc stearate, and these components were mixed with each other in a container-rotating/vibrating type powder mixer. A step of subjecting this mixture to pressing, subsequent steps, and methods for evaluating properties of the resultant were the same as described in the above-mentioned steps and items (2), (3) and (A) to (G). In the present Working Examples, the pressure at the pressing time was adjusted to set the density dg of the compacts to $6.0\times10^3$ kg/m$^3$.

TABLR 6

| Alloy grains | Al (% by mass) | Cr (% by mass) | Si (% by mass) | Zr (% by mass) | Hf (% by mass) | Fe | d50 (μm) |
|---|---|---|---|---|---|---|---|
| No.8 | 5.06 | 4.00 | 0.20 | 0.05 | — | bal. | 12.7 |
| No.9 | 5.08 | 4.04 | 0.21 | 0.09 | — | bal. | 13.2 |
| No.10 | 4.90 | 3.94 | 0.20 | 0.25 | — | bal. | 12.7 |
| No.11 | 4.96 | 3.86 | 0.20 | 0.57 | — | bal. | 11.7 |
| No.12 | 4.95 | 3.93 | 0.20 | 0.96 | — | bal. | 12.2 |
| No.13 | 4.87 | 3.92 | 0.21 | — | 0.21 | bal. | 12.0 |

Evaluated Results of the properties of the magnetic cores as obtained as described above are shown in Table 7. In Table 7, any value of the magnetic core loss Pcv is a value measured at a frequency of 300 kHz and an excited magnetic flux density of 30 mT. In the present Working Examples, the specific resistances of the magnetic cores were each as high as $300\times10^3$ Ω·m or more. It can be considered that a reason therefor is as follows: in the present Working Examples, a control was made at the pressing time to make the respective densities somewhat lower than in Working Examples 1 to 5; thus, gaps between the metal grains became large, so that relatively thick grain boundary phases were produced to be embedded into the gaps at the heat treatment time. In this state also, the addition of Zr in a proportion of 0.09% or more by mass made the resultant magnetic core higher in specific resistance, and a proportion of 0.25% or more by mass gave a very high specific resistance in the order of $10^6$ Ω·m. It was also verified that the radial crushing strength was made higher with the addition of Zr. Furthermore, also in Working Example 11, in which instead of Zr, Hf was added in a proportion of 0.21% by mass, the magnetic core gained a high specific resistance in the order of $10^6$ Ω·m, and an improved radial crushing strength.

TABLE 7

| | Alloy grains | Compact density dg ($\times10^3$ kg/m$^3$) | Density ds after annealing ($\times10^3$ kg/m$^3$) | Space factor (%) | Magnetic core loss Pcv (kW/m$^3$) | Initial permeability $\mu_i$ | Incremental permeability $\mu_\Delta$ | Radial crushing strength (MPa) | Specific resistance ($\times10^3$ Ω · m) |
|---|---|---|---|---|---|---|---|---|---|
| Working Example 6 | No.8 | 5.97 | 6.12 | 84.1 | 537 | 37.3 | 22.3 | 181 | 300 |
| Working Example 7 | No.9 | 5.98 | 6.16 | 84.7 | 593 | 36.2 | 22.3 | 200 | 860 |
| Working Example 8 | No.10 | 5.97 | 6.16 | 84.7 | 666 | 33.4 | 21.7 | 223 | 1400 |
| Working Example 9 | No.11 | 5.99 | 6.12 | 84.1 | 710 | 27.2 | 20.1 | 219 | 1500 |
| Working Example 10 | No.12 | 5.99 | 6.13 | 84.3 | 746 | 23.9 | 18.3 | 201 | 1200 |
| Working Example 11 | No.13 | 6.05 | 6.24 | 85.8 | 553 | 36.9 | 22.7 | 214 | 1100 |

The present embodiments have demonstrated Working Examples including Zr or Hf as a metal which is not easily dissolved in iron into a solid solution. However, instead of or in addition to this element, the magnetic core may include at least one of Y, Nb, La and Ta. In such a case, in the same manner as magnetic cores including Zr or Hf, a strong oxidized coat film for restraining the diffusion of Fe effectively is produced onto a grain boundary phase to improve the magnetic core in specific resistance because these metals are each not easily dissolved in iron into a solid solution and further any oxide thereof is larger in absolute value of standard production Gibbs energy than $ZrO_2$ and $HfO_2$.

Second Aspect

About the second aspect of the present invention, a description will be specifically made. About others than matters described below, the second aspect is substantially the same as the first aspect. Thus, the description will be made mainly about differences to omit common matters between the two. Moreover, to constituents corresponding to the constituents described about the first aspect are attached the same reference numbers, respectively, to omit any overlapped description thereabout. As will be detailed later, the magnetic core of the second aspect includes alloy phases each including Fe-based soft magnetic alloy grains including M2, Si, and R, and has a structure in which the alloy phases are connected to each other through a grain boundary phase.

Figure 13:
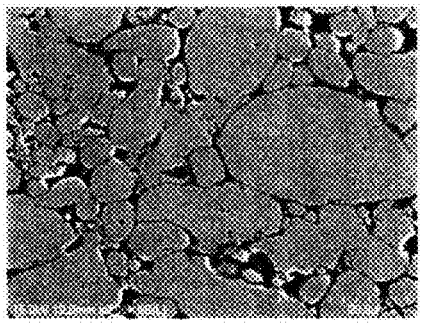
FIG. 13 is an SEM photograph obtained by observing a cross section of a magnetic core in accordance with the second aspect of the present invention.

An external appearance of the magnetic core according to the second aspect is exemplified in FIG. 1. As shown in a magnetic-core-cross-section-observed view of FIG. 13, this magnetic core 1 has plural alloy phases, and a grain boundary phase through which the alloy phases are connected to each other, and has, in a cross section thereof, a microstructure as shown in, e.g., FIG. 14. This microstructure of the cross section is viewed through an observation at a magnifying power of 600000 or more, using, e.g., a transmission electron microscope (TEM). This structure includes alloy phases 20 which each include Fe, Si and M2 and are in the form of grains. Any adjacent two of the alloy phases 20 are connected to each other through a grain boundary phase 30. M2 is either elements of Al or Cr. The grain boundary phase 30 has an oxide region including Fe, M2, Si and R and further including M2 (that is, Al or Cr) in a larger proportion by mass than the alloy phases 20. The oxide region has the following at an interface side of this region, the interface being an interface between the oxide region and the alloy phases 20: a region including R in a larger proportion than the alloy phases 20. R is at least one element selected from the group consisting of Y, Zr, Nb, La, Hf and Ta.

The alloy phases 20 are each formed by Fe-based soft magnetic alloy grains including M2, Si and R and including, as the balance of the grains, Fe and inevitable impurities. The non-ferrous metals (that is, M2, Si and R) included in the Fe-based soft magnetic alloy grains are each larger in affinity with O (oxygen) than Fe. Respective oxides of these non-ferrous metals, or multiple oxides of the non-ferrous metals with Fe form the grain boundary phase 30 between the alloy phases. Fe and the respective oxides of the non-ferrous metals have a higher electrical resistance than a simple substance of each of the metals, so that the grain boundary phase 30 intervening between the alloy phases 20 functions as an insulating layer.

The Fe-based soft magnetic alloy grains used for forming the alloy phases 20 include, as a main component highest in content by percentage, Fe among the constituting components of the grains. The grains include, as secondary components thereof, Si, M2 and R. Each of R is not easily dissolved in Fe into a solid solution. Additionally, the absolute value of the standard production Gibbs energy of the oxide is relatively large (the oxide is easily produced). The Fe-based soft magnetic alloy grains contain Fe preferably in a proportion of 80% or more by mass, this proportion being dependent on the balance between Fe and the other non-ferrous metals. This case makes it possible to yield a soft magnetic alloy high in saturation magnetic flux density. M2 is large in affinity with O. In the heat treatment, O, which is contained in the air atmosphere or a binder, is preferentially bonded to M2 of the Fe-based soft magnetic alloy grains, so that chemically stable oxides are produced on the surface of the alloy phases 20.

The Fe-based soft magnetic alloy grains contain either Al or Cr preferably in a proportion of 1.5 to 8% both inclusive parts by mass. If this proportion is less than 1.5% by mass, any oxide including Al or Cr may not be sufficiently produced so that insulating property and corrosion resistance may be lowered. The Al or Cr content is more preferably 2.5% or more by mass, even more preferably 3% or more by mass. In the meantime, if this proportion is more than 8% by mass, the quantity of Fe is decreased so that the magnetic core may be deteriorated in magnetic properties, for example, the core may be lowered in saturation magnetic flux density and initial permeability and be increased in coercive force. The Al or Cr content is more preferably 7% or less by mass, even more preferably 6% or less by mass.

In the same manner as Al or Cr, Si is bonded to O to produce $SiO_2$, which is chemically stable, and multiple oxides of the other non-ferrous metals with Si. The Si-including oxides are excellent in corrosion resistance and stability to heighten the insulating property between the alloy phases 20, so that the magnetic core can be decreased in eddy current loss. Although Si has effects of improving the magnetic permeability of the magnetic core and lowering the magnetic loss thereof, an excessively large content by percentage of Si makes the alloy grains hard to deteriorate the grains in fillability into a die. Thus, a compact obtained therefrom by pressing tends to be decreased in density to be lowered in magnetic permeability and be increased in magnetic loss.

The Fe-based soft magnetic alloy grains contain Si in a proportion more than 1% by mass and 7% or less by mass. If this proportions is 1% or less by mass, Si-including oxides may not be sufficiently produced. Thus, the magnetic core is deteriorated in magnetic core loss and does not gain a sufficient effect of improving the magnetic permeability by Si. In order to improve the magnetic core loss and the magnetic permeability, the Si content is preferably 3% or more by mass. In the meantime, if the Si content is more than 7% by mass, the magnetic core tends to be lowered in magnetic permeability for the above-mentioned reason and be increased in magnetic loss. The Si content is preferably 5% or less by mass to make the magnetic core high in specific resistance and strength, and simultaneously low in magnetic loss to prevent a fall in the magnetic permeability thereof effectively.

As has been already described, R is not easily dissolved in Fe into a solid solution, and further the absolute value of the standard product Gibbs energy of any oxide thereof is large so that R is strongly bonded to O to produce a stable oxide easily. Accordingly, R precipitates easily in the form of an oxide of R. This oxide, together with any Al or Cr oxide that constitutes a main body of the oxide region making its appearance on the grain boundary phase in the heat treatment, forms a strong oxidized coat film.

The Fe-based soft magnetic alloy grains include R preferably in a proportion of 0.01 to 3% both inclusive by mass. If this proportion is less than 0.01% by mass, an R-including oxide is not sufficiently produced so that R may not sufficiently produce the improving effect for specific resistance. The R content is more preferably 0.1% or more by mass, even more preferably 0.2% or more by mass, particularly preferably 0.3% or more by mass. In the meantime, if this proportion is more than 3% by mass, the magnetic core may undergo, for example, an increase in magnetic core loss not to gain magnetic properties appropriately. The R content is more preferably 1.5% or less by mass, even more preferably 1.0% or less by mass, even more preferably 0.7% or less by mass, particularly preferably 0.6% or less by mass. When R is two or more elements selected from the group consisting of Y, Zr, Nb, La, Hf and Ta, the proportion of the total amount of these elements is preferably from 0.01 to 3% both inclusive by mass.

The Fe-based soft magnetic alloy grains may contain C, Mn, P, S, O, Ni, N and others as inevitable impurities. The preferred content by percentage of each of these inevitable impurities is as described about the first aspect.

Figure 14:
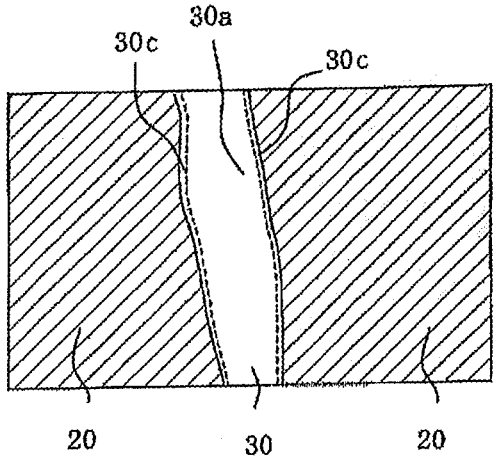
FIG. 14 is SEM photograph obtained by observing a cross section of a magnetic core of FIG. 13.

In the example in FIG. 14, an oxide including R (such as Zr) is produced in any edge part 30*c* of the oxide region along the interface between the alloy phases 20 and the grain boundary phase 30. As has been already described, the oxide region contains Al or Cr in a larger proportion than the alloy phases 20. In the oxide region, the edge part 30*c* contains R in a larger proportion than a central part. The production of the R-including oxide along the edge part 30*c* effectively restrains the diffusion of Fe from the alloy phases 20 to the grain boundary phase 30 to heighten the insulating property of the magnetic core by the oxide region, thereby contributing to an improvement thereof in specific resistance.

It is preferred that the alloy phases are in the form of grains, and the alloy phases are each independent through the grain boundary phase without being brought into direct contact. The structure which the magnetic core has includes the alloy phases and the grain boundary phase, and the grain boundary phase is formed by oxidizing the Fe-based soft magnetic alloy grains. Accordingly, the alloy phases are different in composition from the above-mentioned Fe-based soft magnetic alloy grains. However, by, e.g., the evaporation and scattering of Fe, M2, Si and R on the basis of the heat treatment such as annealing, a shift or deviation of the composition is not easily caused so that in any region including the alloy phases and the grain boundary phase, the composition of the magnetic core from which O is excluded becomes substantially equal in composition to the Fe-based soft magnetic alloy grains. Accordingly, a magnetic core formed using Fe-based soft magnetic alloy grains as described above is a core which includes M2 in a proportion of 1.5 to 8% both inclusive by mass, Si in a proportion more than 1% by mass and 7% or less by mass, and R in a proportion of 0.01 to 3% both inclusive by mass provided that the sum of the quantities of Fe, M2, Si and R is regarded as being 100% by mass; and which includes Fe and inevitable impurities as the balance of the core.

The coil component according to the present invention may be a component having a magnetic core as described above, and a coil fitted to the magnetic core. An example of the external appearance thereof is illustrated in FIG. 3. The structure of the coil component is as described about the first aspect. The radial crushing strength of this magnetic core is preferably 100 MPa or more.

A method for manufacturing this magnetic core includes the step of mixing a binder with Fe-based soft magnetic alloy grains including M2 (wherein M2 represents either elements of Al or Cr), Si, and R (wherein R represents at least one element selected from the group consisting of Y, Zr, Nb, La, Hf and Ta) to yield a mixed powder (first step); the step of subjecting the mixed powder to pressing to yield a compact (second step); and the step of subjecting the compact to heat treatment in an atmosphere including oxygen to yield a magnetic core having a structure including alloy phases and grain boundary phases including the Fe-based soft magnetic alloy grains (third step). By this heat treatment, the grain boundary phase 30 is formed, through which any adjacent the alloy phases 20 are connected to each other. Simultaneously, in the grain boundary phase 30, an oxide region is produced which includes Fe, M2, Si and R, and further includes M2 in a larger proportion by mass than the alloy phase 20. In the oxide region, the ratio of the quantity of M2 to the sum of the quantities of Fe, M2, Si and R is higher than in respective inner parts of the alloy phases 20.

In the first step, Fe-based soft magnetic alloy grains are used which include M2 in a proportion of 1.5 to 8% both inclusive by mass, Si in a proportion more than 1% by mass and 7% or less by mass, and R in a proportion of 0.01 to 3% both inclusive by mass provided that the sum of the quantities of Fe, M2, Si and R is regarded as being 100% by mass; and including Fe and inevitable impurities as the balance of the grains. A more preferred composition and others of the Fe-based soft magnetic alloy grains are as described above. Thus, any overlapped description thereabout is omitted.

The following described about the first aspect are each applicable to the second aspect: the items about the first step, such as the grain diameter and the producing method of the Fe-based soft magnetic alloy grains, the binder, the granule, the lubricant, and others; the items about the second step, such as the pressing, the compact obtained by the pressing, and others; and the items about the third step, such as the atmosphere for the heat treatment (annealing), the annealing temperature, and others. Furthermore, the space factor of the magnetic core obtained through the heat treatment, the thickness of the grain boundary phase, the maximum diameter and the abundance ratio of the alloy phases, and others are as described about the first aspect. However, any oxide region produced in the grain boundary phase is a region including Fe, M2, Si and R, and including M2 in a larger proportion by mass than the alloy phases.

When a scanning electron microscope (SEM/EDX) is used after the annealing to observe a cross section of the magnetic core, and examine a distribution of each of the constituting elements thereof, it is observed that in the oxide region formed in the grain boundary phase 30, M2 (Cr or Al) is concentrated. When a transmission electron microscope (TEM) is used to observe a cross section of the magnetic core, the oxide region is observed with a lamellar structure as illustrated in FIG. 14.

When the composition thereof is analyzed in more detail (TEM-EDX: transmission electron microscope with energy dispersive X-ray spectroscopy), it is observed that the oxide region includes Fe, M2, Si and R. Additionally, in the edge part 30*c* of the oxide region that is near the alloy phases 20, R-including oxides make their appearance along the interface between the alloy phases 20 and the grain boundary phase 30. The oxide region is a region in which the ratio of the quantity of M2 to the sum of the quantities of Fe, M2, Si and R is higher than that of the quantity of each of Fe, Si, and R thereto.

EXAMPLES OF SECOND ASPECT

A description will be specifically made about (working) examples of the second aspect of the present invention. Each of Fe-based soft magnetic alloy grain species was produced by a water atomizing method, and then the resultant grains were passed through a 440-mesh (sieve opening size: 32 μm) sieve to remove coarse grains. About the remaining alloy grains, Table 8 shows measured results of an analysis of the composition and the average grain diameter (median diameter d50). In the present Working Example, Cr and Zr were selected as selective elements M2 and R, respectively. The method and the machine used to make the composition analysis and the grain diameter measurement are as described about the first aspect. The Fe-based soft magnetic alloy grains were used to produce a magnetic core through the steps of (1) mixing, (2) pressing and (3) heat treatment. The resultant magnetic cores were called Working Example 12 and Comparative Example 2, respectively. The steps (1) to (3) were the same as in the first aspect except that the pressure at the pressing time was set to 0.93 GPa.

TABLE 8

| | Proportions (% by mass) in composition | | | | Average grain diameter |
|---|---|---|---|---|---|
| | Fe | Si | Cr | Zr | d50 (μm) |
| Working Example 12 | bal. | 3.5 | 4 | 0.3 | 10.1 |
| Comparative Example 2 | bal. | 3.5 | 4 | 0 | 9.8 |

About the magnetic cores as described above, the following individual properties were evaluated: (A) the density ds after the annealing, (B) the space factor (relative density), (C) the magnetic core loss Pcv, (D) the initial permeability μi, (E) the incremental permeability $\mu_\Delta$, (F) the radial crushing strength σr, and (G) the specific resistance ρ (electric resistivity). Methods for evaluating these properties were the same as in the first aspect. In Table 9 are shown respective evaluated results of these properties of Working Example 12 and Comparative Example 2. In Table 9, any value of the magnetic core loss Pcv is a value measured at a frequency of 300 kHz and an excited magnetic flux density of 30 mT.

TABLE 9

| | Heat treatment temperature (° C.) | Density ds after annealing ($\times 10^3$ kg/m$^3$) | Space factor (%) | Magnetic core loss Pcv (kW/m$^3$) | Initial permeability $\mu_i$ | Incremental permeability $\mu_\Delta$ | Radial crushing strength (MPa) | Specific resistance (kΩ · m) |
|---|---|---|---|---|---|---|---|---|
| Working Example 12 | 700 | 6.27 | 82.2 | 598 | 31 | 23.1 | 113 | 3.5 |
| Comparative Example 2 | 700 | 6.25 | 82.0 | 536 | 35 | 23.3 | 75 | 0.46 |

As shown in Table 9, Working Example 12, which included Zr, was better in specific resistance than Comparative Example 2 to gain an excellent specific resistance of $1\times10^5$ Ω·m or more.

No remarkable difference was observed in magnetic core density therebetween. However, Working Example 12, which included Zr, was better in radial crushing strength than Comparative Example 2 to gain an excellent radial crushing strength more than 100 MPa. Moreover, Working Example 12 had an initial permeability more than 25. This value was equivalent to that of Comparative Example 2, and was at such a level that no hindrance was given for practical use.

About these magnetic cores, their cross section was observed, using a scanning electron microscope (SEM/EDX), and simultaneously their distribution of each of the constituting elements was examined. In each of Working Example 12 and Comparative Example 2, it was observed that a grain boundary phase between alloy phases was high in Cr concentration; moreover, O was also large in proportion, so that oxides were produced; and any adjacent the alloy phases were bonded to each other through the oxide region. Further, in the grain boundary phase, Fe was lower in concentration than inside the alloy phases.

The magnetic core of Working Example 12 was cut. In a cut surface thereof, its alloy phases and its grain boundary phase, through which the alloy phase were connected to each other, were observed through a transmission electron microscope (TEM) at a magnifying power of 600,000. In the observed image, the oxide region of the grain boundary phase exhibited, in between the following regions of this oxide region, color tone different from each other: a region including a central part in the thickness direction of the grain boundary phase; and an edge part of the grain boundary phase which was near to the interface between this grain boundary phase and the alloy phases. Furthermore, the oxide region was in a lamellar form. In the grain boundary phase, through which the adjacent alloy phases were connected to each other, the oxide region was produced, which included Fe, Si, Cr and Zr and included Cr in a large proportion than the alloy phases. Moreover, inside the edge part of the oxide region, in the edge part 30*c* of the oxide region which was near the interface between the alloy phases and the grain boundary phase, Zr was present in a larger proportion than in the alloy phase. In the central part 30*a* of the oxide region, Zr was hardly present. It can be considered that in such a way, the Cr- and Zr-including oxides coated the surface of the alloy phase, thereby restraining the diffusion of Fe at the heat treatment time to improve the magnetic core in specific resistance.

The present embodiment have demonstrated Working Example in which Cr was selected as the selective element M2. However, instead of this element, Al may be selected. Al has an even larger affinity with O than Cr. O, which is contained in the air atmosphere or the binder, is preferentially bonded to Al near the surface of the Fe-based soft magnetic alloy grains to form $Al_2O_3$, which is chemically stable, or multiple oxides of the other non-ferrous metals with Al on the surface of the alloy phases. Moreover, instead of or in addition to Zr, the magnetic core of the present invention may include at least one of Y, Nb, La, Hf and Ta as the selective element R. In such a case, in the same manner as when magnetic cores include Zr, a strong oxidized film coat for restraining the diffusion of Fe effectively is produced onto a grain boundary phase to improve the magnetic core in specific resistance and strength because these metals are each not easily dissolved in Fe into a solid solution and further any oxide thereof is larger in absolute value of standard production Gibbs energy than $ZrO_2$.

DESCRIPTION OF REFERENCE SIGNS

1: Magnetic core
20: Alloy phases

30: Grain boundary phase
30*a*: First region (central part) of oxide region
30*b*: Second region of oxide region
30*c*: Third region (edge part) of oxide region

The invention claimed is:

1. A magnetic core, which comprises alloy phases each comprising Fe-based soft magnetic alloy grains comprising M1 (wherein M1 represents both elements of Al and Cr), Si, and R (wherein R represents at least one element selected from the group consisting of Y, Zr, Nb, La, Hf and Ta), and which has a structure in which the alloy phases are connected to each other through a grain boundary phase formed by oxidizing the Fe-based soft magnetic alloy grains, wherein in an observation image of a cross section of the magnetic core through SEM at a magnifying power of 1,000, an abundance ratio of alloy phases having a maximum diameter of 40 μm or more is 1% or less, wherein the grain boundary phase comprises an oxide region comprising Fe, M1, Si and R and further comprising Al in a larger proportion by mass than the alloy phases, and the oxide region includes a region having a higher proportion of the quantity of R than a region which is different from the higher-R-proportion region and is inside the oxide region.

2. The magnetic core according to claim 1, wherein a content of Al is 3 to 10% by mass, a content of Cr is 3 to 10% by mass, a content of R is 0.01 to 1% by mass, considering that the sum of the quantities of Fe, M1 and R is regarded as being 100% by mass.

3. The magnetic core according to claim 2, comprising R in a proportion of 0.3% or more by mass.

4. The magnetic core according to claim 2, comprising R in a proportion of 0.6% or less by mass.

5. The magnetic core according to claim 1, wherein R represents Zr or Hf.

6. The magnetic core according to claim 1, wherein the grain boundary phase has: a first region where the ratio of the quantity of Al to the sum of the quantities of Fe, M1, Si and R is higher than the ratio of the quantity of each of Fe, Cr, Si and R thereto; and a second region where the ratio of the quantity of Fe to the sum of the quantities of Fe, M1, Si and R is higher than the ratio of the quantity of each of M1, Si and R thereto.

7. The magnetic core according to claim 1, having a specific resistance of $1\times10^5$ Ω·m or more, and a radial crushing strength of 120 MPa or more.

8. A coil component, comprising the magnetic core recited in claim 1, and a coil fitted to the magnetic core.

9. A magnetic core, which comprises alloy phases each comprising Fe-based soft magnetic alloy grains comprising M2 (wherein M2 represents either Al or Cr), Si, and R (wherein R represents at least one element selected from the group consisting of Y, Zr, Nb, La, Hf and Ta), and which has a structure in which the alloy phases are connected to each other through a grain boundary phase formed by oxidizing the Fe-based soft magnetic alloy grains, wherein in an observation image of a cross section of the magnetic core through SEM at a magnifying power of 1,000, an abundance ratio of alloy phases having a maximum diameter of 40 μm or more is 1% or less, wherein the grain boundary phase comprises an oxide region comprising Fe, M2, Si and R and further comprising M2 in a larger proportion by mass than the alloy phases, and the oxide region includes a region having a higher proportion of the quantity of R than a region which is different from the higher-R-proportion region and is inside the oxide region.

10. The magnetic core according to claim 9, wherein R represents Zr or Hf.

11. A coil component, comprising the magnetic core recited in claim 9, and a coil fitted to the magnetic core.

12. The magnetic core according to claim 9, comprising M2 in a proportion of 1.5 to 8% both inclusive by mass, Si in a proportion more than 1% by mass and 7% or less by mass, and R in a proportion of 0.01 to 3% both inclusive by mass provided that the sum of the quantities of Fe, M2, Si and R is regarded as being 100% by mass; and comprising Fe and inevitable impurities as the balance of the core.

13. The magnetic core according to claim 12, comprising R in a proportion of 0.3% or more by mass.

14. The magnetic core according to claim 12, comprising R in a proportion of 0.6% or less by mass.

15. A magnetic core manufacturing method, comprising the steps of:

mixing a binder with Fe-based soft magnetic alloy grains comprising M1 (wherein M1 represents both elements of Al and Cr), Si, and R (wherein R represents at least one element selected from the group consisting of Y, Zr, Nb, La, Hf and Ta) to yield a mixed powder;

subjecting the mixed powder to pressing to yield a compact; and subjecting the compact to heat treatment in an atmosphere comprising oxygen to yield a magnetic core having a structure comprising alloy phases comprising the Fe-based soft magnetic alloy grains;

wherein the heat treatment results in: forming a grain boundary phase through which the alloy phases are connected to each other; and further producing, in the grain boundary phase, an oxide region comprising Fe, M1, Si and R and further comprising Al in a larger proportion by mass than the alloy phases, wherein the magnetic core comprises alloy phases each comprising Fe-based soft magnetic alloy grains comprising M1 (wherein M1 represents both elements of Al and Cr), Si, and R (wherein R represents at least one element selected form the group consisting of Y, Zr, Nb, La, Hf and Ta), and has a structure in which the alloy phases are connected to each other through a grain boundary phase formed by oxidizing the Fe-based soft magnetic alloy grains, wherein in an observation image of a cross section of the magnetic core through SEM at a magnifying power of 1,000, an abundance ratio of alloy phases having a maximum diameter of 40 μm or more is 1% or less, wherein the grain boundary phase comprises an oxide region comprising Fe, M1, Si and R and further comprising Al in a larger proportion by mass than the alloy phases, and the oxide region includes a region having a higher proportion of the quantity of R than a region which is different from the higher-R-proportion region and is inside the oxide region.

16. A magnetic core manufacturing method, comprising the steps of:

mixing a binder with Fe-based soft magnetic alloy grains comprising M2 (wherein M2 represents either Al or Cr), Si, and R (wherein R represents at least one element selected from the group consisting of Y, La, Zr, Hf, Nb and Ta) to yield a mixed powder; and subjecting the mixed powder to pressing to yield a compact;

subjecting the compact to heat treatment in an atmosphere comprising oxygen to yield a magnetic core having a structure comprising alloy phases comprising the Fe-based soft magnetic alloy grains;

wherein the heat treatment results in: forming a grain boundary phase through which the alloy phases are connected to each other; and further producing, in the grain boundary phase, an oxide region comprising Fe, M2, Si and R and further comprising M2 in a larger proportion by mass than the alloy phases, wherein the magnetic core comprises alloy phases each comprising Fe-based soft magnetic alloy grains comprising M2 (wherein M2 represents either Al or Cr), Si, and R (wherein R represents at least one element selected form the group consisting of Y, Zr, Nb, La, Hf and Ta), and has a structure in which the alloy phases are connected to each other through a grain boundary phase formed by oxidizing the Fe-based soft magnetic alloy grains, wherein in an observation image of a cross section of the magnetic core through SEM at a magnifying power of 1,000, an abundance ratio of alloy phases having a maximum diameter of 40 μm or more is 1% or less, wherein the grain boundary phase comprises an oxide region comprising Fe, M2, Si and R and further comprising M2 in a larger proportion by mass than the alloy phases, and the oxide region includes a region having a higher proportion of the quantity of R than a region which is different from the higher-R-proportion region and is inside the oxide region.

* * * * *